US010604386B2

(12) United States Patent
Kawabuchi et al.

(10) Patent No.: US 10,604,386 B2
(45) Date of Patent: Mar. 31, 2020

(54) EXPANSION/CONTRACTION MECHANISM

(71) Applicant: TADANO LTD., Kagawa (JP)

(72) Inventors: Naoto Kawabuchi, Kagawa (JP); Takashi Kawano, Kagawa (JP)

(73) Assignee: TADANO LTD., Kagawa (JP)

( * ) Notice: Subject to any disclaimer, the term of this patent is extended or adjusted under 35 U.S.C. 154(b) by 103 days.

(21) Appl. No.: 16/081,647

(22) PCT Filed: Mar. 3, 2017

(86) PCT No.: PCT/JP2017/008490
§ 371 (c)(1),
(2) Date: Aug. 31, 2018

(87) PCT Pub. No.: WO2017/150706
PCT Pub. Date: Sep. 8, 2017

(65) Prior Publication Data

US 2019/0010029 A1 Jan. 10, 2019

(30) Foreign Application Priority Data

Mar. 3, 2016 (JP) ..... 2016-041260

(51) Int. Cl.
*B66C 23/70* (2006.01)
*B66C 23/00* (2006.01)
(Continued)

(52) U.S. Cl.
CPC ..... *B66C 23/705* (2013.01); *B66C 23/54* (2013.01); *B66C 23/708* (2013.01); *F15B 3/00* (2013.01);
(Continued)

(58) Field of Classification Search
CPC ..... B66C 23/54; B66C 23/705; B66C 23/708; F15B 11/20; F15B 15/149; F15B 15/26;
(Continued)

(56) References Cited

U.S. PATENT DOCUMENTS 4,327,533 A * 5/1982 Sterner ..... B66C 23/708 212/292
4,492,311 A * 1/1985 Rathe ..... B66C 23/708 212/227
(Continued)

FOREIGN PATENT DOCUMENTS

JP 4709431 B2 6/2011

OTHER PUBLICATIONS

May 9, 2017, International Search Report issued for related PCT application No. PCT/JP2017/008490.
(Continued)

*Primary Examiner* — Sang K Kim
*Assistant Examiner* — Nathaniel L Adams
(74) *Attorney, Agent, or Firm* — Paratus Law Group, PLLC

(57) ABSTRACT

An expansion/contraction mechanism includes a telescopic cylinder, boom fixing means, cylinder-boom connecting means, and a hydraulic-pressure supply unit, and telescopes a plurality of booms except a base boom by telescoping the telescopic cylinder. The hydraulic-pressure supply unit includes a pneumatic-pressure source, a selector valve which selects a destination of air provided from the pneumatic-pressure source, a first pneumatic path through which first air sent from the selector valve circulates, a second pneumatic path through which second air sent from the selector valve circulates, a first pneumatic-to-hydraulic conversion unit which converts a pneumatic pressure provided by the first air to a hydraulic pressure and supplies the hydraulic pressure to a first hydraulic cylinder, and a second pneumatic-to-hydraulic conversion unit which converts a pneumatic pressure provided by the second air to a hydraulic pressure and supplies the hydraulic pressure to a second hydraulic cylinder.

5 Claims, 13 Drawing Sheets

(51) Int. Cl.

| | |
|---|---|
| *F15B 15/14* | (2006.01) |
| *F15B 15/26* | (2006.01) |
| *F15B 15/16* | (2006.01) |
| *F15B 3/00* | (2006.01) |

(52) U.S. Cl.
CPC ..... *F15B 15/149* (2013.01); *F15B 15/16* (2013.01); *F15B 15/26* (2013.01)

(58) Field of Classification Search
CPC .... F15B 3/00; F15B 2211/7052; F15B 15/16; F15B 2211/71; F15B 2211/7057
See application file for complete search history.

(56) References Cited

U.S. PATENT DOCUMENTS

| | | | | |
|---|---|---|---|---|
| 5,628,416 | A * | 5/1997 | Frommelt | B66C 23/705 212/292 |
| 9,688,519 | B2 * | 6/2017 | Kawabuchi | B66C 23/22 |
| 9,738,498 | B2 * | 8/2017 | Kawabuchi | B66C 23/705 |
| 2015/0060385 | A1 * | 3/2015 | Matsuda | B66C 23/708 212/349 |
| 2015/0144583 | A1 * | 5/2015 | Matsumoto | B66F 9/22 212/276 |

OTHER PUBLICATIONS

May 9, 2017, International Search Opinion issued for related PCT application No. PCT/JP2017/008490.

* cited by examiner

FIG. 7

| NO | Boom | % | | | | |
|---|---|---|---|---|---|---|
| | | 2 | 3 | 4 | 5 | 6 |
| 1 | 11.7m | 0 | 0 | 0 | 0 | 0 |
| 2 | 15.5m | 0 | 0 | 0 | 0 | 47 |
| 3 | 19.2m | 0 | 0 | 0 | 0 | 93 |
| 4 | 23.0m | 0 | 0 | 0 | 47 | 93 |
| 5 | 26.7m | 0 | 0 | 0 | 93 | 93 |
| 6 | 30.5m | 0 | 0 | 47 | 93 | 93 |
| 7 | 34.2m | 0 | 0 | 93 | 93 | 93 |
| 8 | 38.0m | 0 | 47 | 93 | 93 | 93 |
| 9 | 41.7m | 0 | 93 | 93 | 93 | 93 |
| 10 | 45.5m | 47 | 93 | 93 | 93 | 93 |
| 11 | 49.2m | 93 | 93 | 93 | 93 | 93 |

107

108

105

106

103

EXPANSION/CONTRACTION MECHANISM

CROSS REFERENCE TO PRIOR APPLICATION

This application is a National Stage Patent Application of PCT International Patent Application No. PCT/JP2017/008490 (filed on Mar. 3, 2017) under 35 U.S.C. § 371, which claims priority to Japanese Patent Application No. 2016-041260 (filed on Mar. 3, 2016), which are all hereby incorporated by reference in their entirety.

TECHNICAL FIELD

The present invention relates to an expansion/contraction mechanism which telescopes a telescopic boom of a mobile crane, and particularly to an expansion/contraction mechanism which telescopes a boom forming a telescopic boom, stage by stage, using a single telescopic cylinder.

BACKGROUND ART

As an expansion/contraction mechanism of a telescopic boom of a mobile crane, an expansion/contraction mechanism which telescopes a boom forming a telescopic boom, stage by stage, using a single telescopic cylinder (hydraulic cylinder) which is contained in the telescopic boom, is brought into practical use (and hereinafter, this expansion/contraction mechanism will be referred to as a "single-cylinder expansion/contraction mechanism") A single-cylinder expansion/contraction mechanism has advantages in that a weight of a whole of an expansion/contraction mechanism can be reduced because of inclusion of a single telescopic cylinder, and that a lifting performance of a mobile crane can be improved (refer to Patent Literature 1, for example).

A typical configuration of a single-cylinder expansion/contraction mechanism includes boom fixing means, fixing-pin driving means, and cylinder-boom connecting means which are described below.

The boom fixing means is placed in each inner boom of adjacent booms. The boom fixing means includes a fixing pin (which will hereinafter be referred to as a "B in") for fixing an inner boom and an outer boom. The boom fixing means moves a B pin back and forth relative to a fixing hole provided in an appropriate portion in an outer boom, to thereby fix or unfix an inner boom and an outer boom which are adjacent to each other (which will hereinafter be referred to as a "a pair of adjacent booms"). A telescopic boom which is extended by a single-cylinder expansion/contraction mechanism is kept being extended by the boom fixing means. The boom fixing means is essential means for a single-cylinder expansion/contraction mechanism.

The fixing-pin driving means is placed in a movable portion (which will hereinafter be referred to as a "telescopic-cylinder movable portion") of a telescopic cylinder. The fixing-pin driving means acts on a B pin in an inner boom of a target pair of adjacent booms (a pair of booms including a boom being telescoped), to move a B pin back and forth. The fixing-pin driving means is used in shifting a state of a pair of adjacent booms from a fixed state to an unfixed state, or from an unfixed state to a fixed state. The fixing-pin driving means, like the boom fixing means, is indispensable for a single-cylinder expansion/contraction mechanism. The fixing-pin driving means (which will hereinafter be referred to as a "B-pin driving means") includes a B-pin cylinder which drives a B pin back and forth. A B-pin cylinder requires a relatively large output though the B-pin cylinder should be placed in a small space of a telescopic-cylinder movable portion, and therefore, a B-pin cylinder includes a hydraulic cylinder.

The cylinder-boom connecting means is placed in a telescopic-cylinder movable portion. The cylinder-boom connecting means includes a connecting pin (which will hereinafter be referred to as a "C pin") for connecting a telescopic-cylinder movable portion and a target boom (a boom being telescoped). The cylinder-boom connecting means moves a C pin back and forth relative to a connecting hole in a boom being telescoped, to thereby selectively connect or disconnect a telescopic-cylinder movable portion and a boom. The cylinder-boom connecting means is indispensable for a single-cylinder expansion/contraction mechanism which telescopes all booms using a single telescopic cylinder. The cylinder-boom connecting means includes C-pin driving means such as a C-pin cylinder which drives a C pin back and forth. A C-pin cylinder requires a relatively large output though a C-pin cylinder should be placed in a small space of a telescopic-cylinder movable portion, and therefore, a hydraulic cylinder is used also for a C-pin cylinder.

FIG. 13 is a view showing a conventional hydraulic circuit (which will hereinafter be referred to as a "B/C-pin-cylinder hydraulic circuit) for supplying a hydraulic pressure to a B-pin cylinder 5 and a C-pin cylinder 7 which are used in a single-cylinder expansion/contraction on mechanism.

In the single-cylinder expansion/contraction mechanism, the B-pin cylinder 5, the C-pin cylinder 7, and electromagnetic selector valves 1 and 9 are placed in a telescopic-cylinder movable portion 3.

The B-pin cylinder 5 which drives a B pin 4 is a single-acting hydraulic cylinder, and contains a spring 20 for a return therein. The B-pin cylinder 5 is driven upon supply of a hydraulic pressure via a single hydraulic pipeline 22.

The C-pin cylinder 7 which drives a C pin 8 is a single-acting hydraulic cylinder. A spring 21 which impels the C pin 8 functions as a spring for a return of the C-pin cylinder 7. The C-pin cylinder 7 is driven upon supply of a hydraulic pressure via a single hydraulic pipeline 23.

A hydraulic pressure is supplied from a telescopic-cylinder fixing-unit side 24 (a side where a base portion of a telescopic boom or a turntable of a crane is provided) to the telescopic-cylinder movable portion 3, while passing through a single long hydraulic hose 6 which is unreeled from, and reeled on, a hose reel 2 placed on the telescopic-cylinder fixing-unit side 24.

The electromagnetic selector valves 1 and 9 supply a hydraulic pressure which is supplied from the single hydraulic hose 6, to the hydraulic pipeline 22 for the B-pin cylinder 5 and the hydraulic pipeline 23 for the C-pin cylinder 7 while performing selecting. More specifically, the electromagnetic selector valve 1 selects either holding or on-holding of a hydraulic pressure which is supplied to the B-pin cylinder 5 or the C-pin cylinder 7. The electromagnetic selector valve 9 selects either supply of a hydraulic pressure to the B-pin cylinder 5 or supply of a hydraulic pressure to the C-pin cylinder 7. In a telescoping process of the single-cylinder expansion/contraction mechanism, the B-pin cylinder 5 and the C-pin cylinder 7 are sequentially driven.

In the above-described B/C-pin-cylinder hydraulic circuit, an increase of viscosity of a hydraulic working fluid at a low temperature results in an increase of pressure loss during passage through the long hydraulic hose 6, so that the B-pin cylinder 5 or the C-pin cylinder 7 operates slowly. This invites an operational delay of the B-pin driving means or C-pin driving means, and causes a fear that the single-cylinder expansion/contraction mechanism may be unable to properly operate. With regard to such a problem, it is possible to ensure operability at a low temperature by increasing an internal diameter of the hydraulic hose 6. However, an increase of an internal diameter of the hydraulic hose 6 results in an increase of a size and a weight of the hose reel 2, and thus, it is not preferable to provide an individual hydraulic-pressure supply system including the hydraulic hose 6 and the hose reel 2 for each of the B-pin cylinder 5 and the C-pin cylinder 7. For this reason, the conventional B/C-pin-cylinder hydraulic circuit employs a configuration in which only one hydraulic-pressure supply system for the telescopic-cylinder movable portion 3 is provided so as to be branched out by the electromagnetic selector valves 1 and 9 provided in the telescopic-cylinder movable portion 3.

CITATION LIST

Patent Literature

Patent Literature 1: JP 4709431 B2

SUMMARY OF THE INVENTION

Problems to be Solved by the Invention

However, in the expansion/contraction mechanism employing the above-described B/C-pin-cylinder hydraulic circuit, the electromagnetic selector valves 1 and 9 in the telescopic-cylinder movable portion 3 are placed in a deep portion inside the telescopic boom, and thus, the valves 1 and 9 are not easily accessible. Also, because of a large length of the telescopic cylinder, when the telescopic cylinder extends to the maximum degree, the telescopic-cylinder movable portion 3 is positioned far from the telescopic-cylinder fixing-unit side 24 where one end of the telescopic cylinder is pivotably supported. Accordingly, it is difficult to do work for maintenance at a time of breakdown of the electromagnetic selector valves 1 and 9 or the like in the conventional expansion/contraction mechanism.

It is an object of the present invention to provide a single-cylinder expansion/contraction mechanism which telescopes a telescopic boom, can ensure operability at a low temperature, and offers greater ease of maintenance.

Solutions to Problems

An expansion/contraction mechanism according to the present invention includes:

a single telescopic cylinder internally mounted onto a telescopic boom into which a plurality of booms including a base boom, an intermediate boom, and a top boom are telescopically fitted and inserted individually, the single telescopic cylinder having one end that is pivotably supported by a base portion of the base boom;

boom fixing means including a fixing pin and a first hydraulic cylinder that is configured to move the fixing pin back and forth, the boom fixing means being configured to fix two adjacent ones of the plurality of booms using the fixing pin;

cylinder-boom connecting means including a connecting pin and a second hydraulic cylinder that is configured to move the connecting pin back and forth, the cylinder-boom connecting means being configured to connect a specific boom to be telescoped out of the plurality of booms except the base boom, and the telescopic cylinder, using the connecting pin; and a hydraulic-pressure supply unit configured to supply a hydraulic pressure to the first hydraulic cylinder and the second hydraulic cylinder, wherein the expansion/contraction mechanism is configured to telescope the plurality of booms except the base boom stage by stage by telescoping the telescopic cylinder while the specific boom and the telescopic cylinder are connected and the two adjacent booms including the specific boom are unfixed, the hydraulic-pressure supply unit includes:

a pneumatic-pressure source;

a selector valve configured to select a destination of air provided from the pneumatic-pressure source;

a first pneumatic path through which first air sent from the selector valve circulates;

a second pneumatic path through which second air sent from the selector valve circulates;

a first pneumatic-to-hydraulic conversion unit configured to convert a pneumatic pressure provided by the first air to a hydraulic pressure and supply the hydraulic pressure to the first hydraulic cylinder; and a second pneumatic-to-hydraulic conversion unit configured to convert a pneumatic pressure provided by the second air to a hydraulic pressure and supply the hydraulic pressure to the second hydraulic cylinder;

the pneumatic-pressure source and the selector valve are placed on a fixing-unit side of the telescopic cylinder, and the first pneumatic-to-hydraulic conversion unit and the second pneumatic-to-hydraulic conversion unit are placed on a movable-portion side of the telescopic cylinder.

Effects of the Invention

According to the present invention, provided is a single-cylinder expansion/contraction mechanism which telescopes a telescopic boom, can ensure operability at a low temperature, and offers greater ease of maintenance.

BRIEF DESCRIPTION OF DRAWINGS

FIG. 7 is a view showing an example of a display screen provided by telescoping-related-information display means.

DESCRIPTION OF EMBODIMENTS

Below, embodiments of the present invention will be described in detail with reference to the drawings.

First Embodiment

Figure 1:
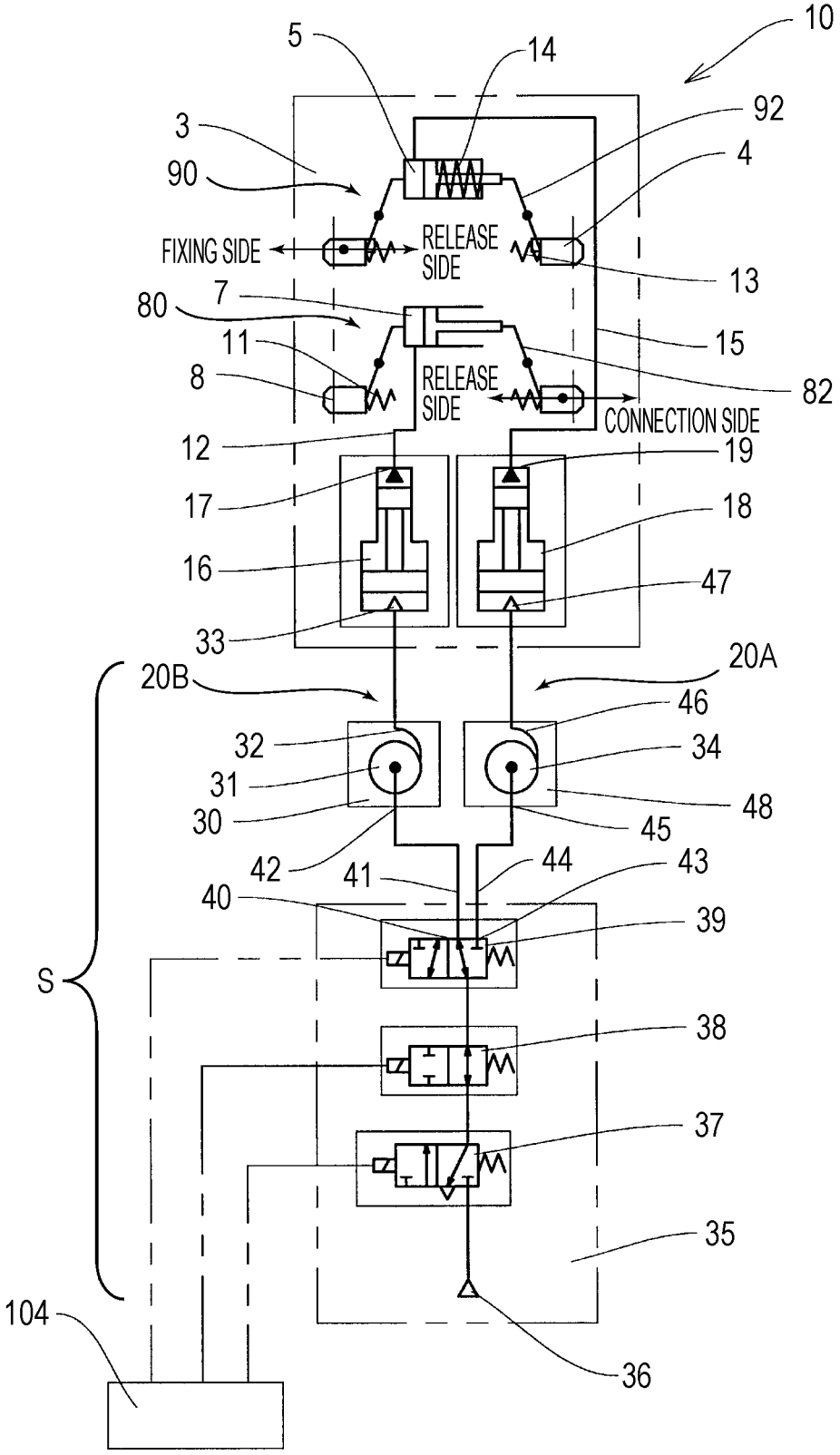
FIG. 1 is a view showing an example of a B/C-pin-cylinder hydraulic circuit of an expansion/contraction mechanism according to a first embodiment.

With reference to FIG. 1, an overview of a hydraulic circuit 10 (which will hereinafter be referred to as a "B/C-pin-cylinder hydraulic circuit 10") for a B-pin cylinder 5 and a C-pin cylinder 7 of an expansion/contraction mechanism according to a first embodiment will be given. The expansion/contraction mechanism is mounted onto a telescopic boom 60 of a mobile crane 154, and telescopes each boom of the telescopic boom 60 stage by stage. FIG. 1 is a view showing an example of the B/C-pin cylinder hydraulic circuit 10 according to the first embodiment. In the first embodiment, each of the B-pin cylinder 5 and the C-pin cylinder 7 includes a single-acting hydraulic cylinder.

As shown in FIG. 1, the B/C-pin cylinder hydraulic circuit 10 includes boom fixing means 90, cylinder-boom connecting means 80, and a B/C-pin-cylinder hydraulic-pressure supply unit S.

The boom fixing means 90 includes a B pin 4 (fixing pin) and the B-pin cylinder 5 (first hydraulic cylinder). The boom fixing means 90 fixes two adjacent booms (a pair of adjacent booms) which are located on inner and outer sides, respectively, out of a plurality of booms 61 to 66 (refer to FIG. 3) using the B pin 4.

The B-pin cylinder 5 is placed in a telescopic-cylinder movable portion 3. The B-pin cylinder 5 is B-pin driving means which acts on the B pin 4 which is placed in an inner boom out of a pair of adjacent booms, so as to move the B pin 4 back and forth. The B-pin cylinder 5 is a single-acting hydraulic cylinder which contains a spring 14 on a rod side thereof and is impelled to a contraction side. The B pin 4 is impelled to a fixing side by a spring 13. The B-pin cylinder 5 and the B pin 4 are associated with each other by a B-pin driving lever 92. When a hydraulic pressure is supplied to the B-pin cylinder 5 via a single hydraulic pipeline 15, the B-pin cylinder 5 extends, so that the B pin 4 is driven toward a release side. On the other hand, when supply of a hydraulic pressure to the hydraulic pipeline 15 is interrupted, the B-pin cylinder 5 contracts due to an impelling force of the spring 14, so that the B pin 4 is driven toward a fixing side due to an impelling force of the spring 13.

The cylinder-boom connecting means 80 includes a C pin 8 (connecting pin) and a C-pin cylinder 7 (second hydraulic cylinder). The cylinder-boom connecting means 80 selectively connects a specific boom being telescoped, out of the plurality of booms 61 to 66 (refer to FIG. 3), and a telescopic cylinder 71 (refer to FIG. 3), using the C pin 8.

The C-pin cylinder 7 is placed in the telescopic-cylinder movable portion 3. The C-pin cylinder 7 is C-pin driving means which moves the C pin 8 back and forth relative to a connecting hole of a specific boom being telescoped. The C-pin cylinder 7 is a single-acting hydraulic cylinder. The C pin 8 is impelled to a connection side by a spring 11. The C-pin cylinder 7 and the C pin 8 are associated with each other by a C-pin driving lever 82. When a hydraulic pressure is supplied to the C-pin cylinder 7 via a single hydraulic pipeline 12, the C-pin cylinder 7 extends, so that the C pin 8 is driven toward a release side. On the other hand, when supply of a hydraulic pressure to the hydraulic pipeline 12 is interrupted, the C-pin cylinder contracts due to an impelling force of the spring 11, so that the C pin 8 is driven toward a connection side. In other words, the spring 11 functions as a spring for a return of the C-pin cylinder 7.

The B/C-pin-cylinder hydraulic-pressure supply unit S includes a pneumatic-pressure supply/exhaust device 35, a first pneumatic path 20A, a second pneumatic path 20B, a first pneumatic-to-hydraulic conversion unit 18, and a second pneumatic-to-hydraulic conversion unit 16.

The first pneumatic-to-hydraulic conversion unit 18 is placed in the telescopic-cylinder movable portion 3. The first pneumatic-to-hydraulic conversion unit 18 is a made-for-B-pin air over hydraulic booster (which will hereinafter be referred to as a "B-pin AOH booster 18") which converts a pneumatic pressure provided from the first pneumatic path 20A, to a hydraulic pressure, and supplies the hydraulic pressure to the B-pin cylinder 5. A hydraulic port 19 of the B-pin AOH booster 18 is connected with the hydraulic pipeline 15 which supplies a hydraulic pressure to the B-pin cylinder 5.

The second pneumatic-to-hydraulic conversion unit 16 is placed in the telescopic-cylinder movable portion 3. The second pneumatic-to-hydraulic conversion unit 16 is a made-for-C-pin air over hydraulic booster (which will hereinafter be referred to as a "C-pin AOH booster 16") which converts a pneumatic pressure provided from the second pneumatic path 20B, to a hydraulic pressure, and supplies the hydraulic pressure to the C-pin cylinder 7. A hydraulic port 17 of the C-pin AOH booster 16 is connected with the hydraulic pipeline 12 which supplies a hydraulic pressure to the C-pin cylinder 7.

The B-pin AOH booster 18 and the C-pin AOH booster 16 convert a low pneumatic pressure to a high hydraulic pressure using piston units having different areas. A configuration and a function of each of the B-pin AOH booster 18 and the C-pin AOH booster 16 are known, and thus, detailed description thereof is omitted.

In this manner, the C-pin cylinder and the B-pin cylinder 5 are connected with the C-pin AOH booster 16 and the B-pin AOH booster 18 which are respectively dedicated thereto, independently of each other. Since the C-pin AOH booster 16 and the B-pin AOH booster 18 are supplied with pneumatic pressures individually, the cylinders 5 and 7 can be sequentially driven even though an electromagnetic selector valve is not placed in the telescopic-cylinder movable portion 3.

The first pneumatic path 20A includes a B-pin hose reel 48, a B-pin pneumatic hose 46, and a B-pin pneumatic pipeline 44.

Figure 3:
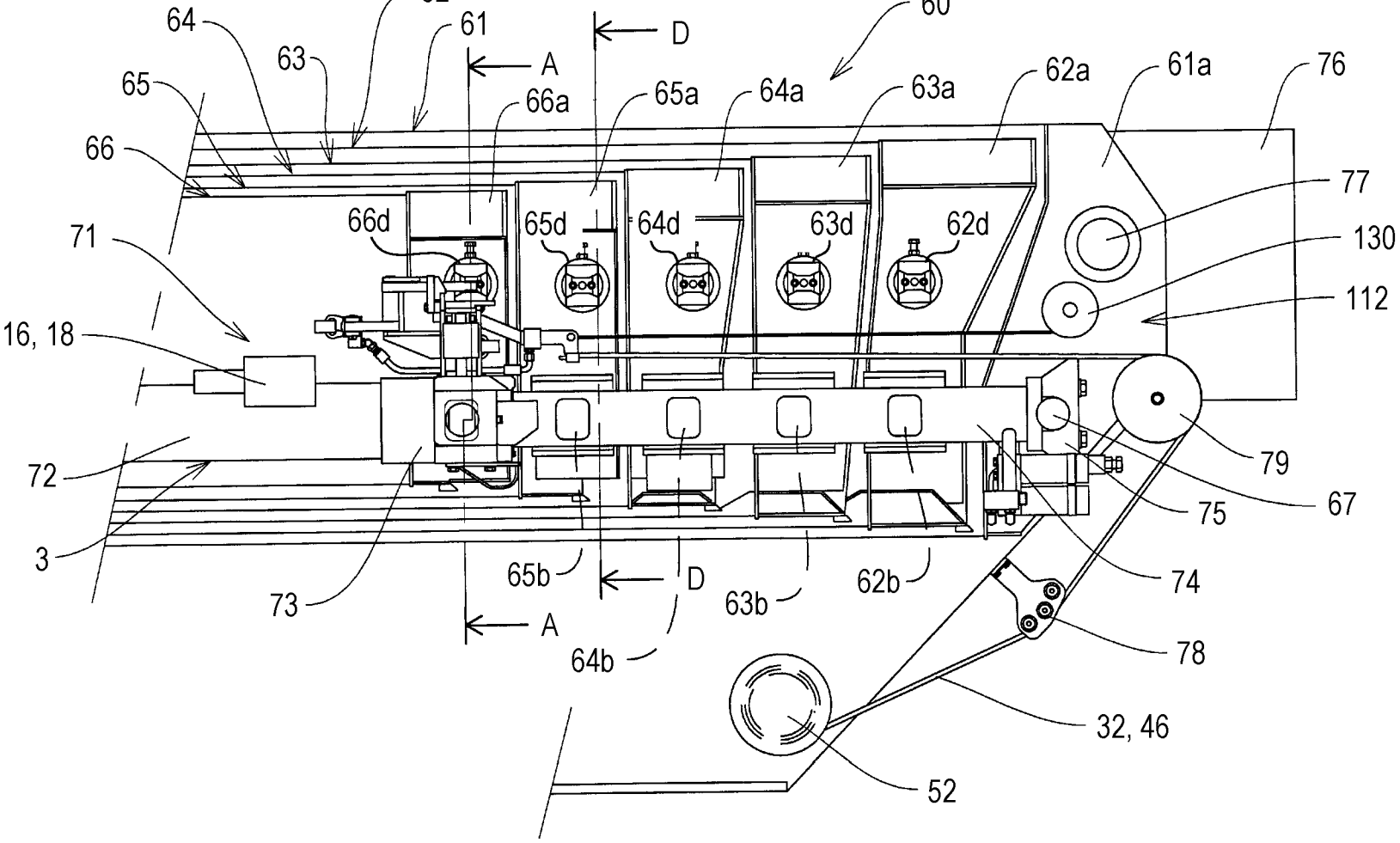
FIG. 3 is a cross-sectional view showing an overall configuration of the expansion/contraction mechanism according to the first embodiment.

The B-pin hose reel 48 is placed on a fixing-unit side (a crane turntable, for example) of the telescopic cylinder 71 (refer to FIG. 3). The B-pin hose reel 48 contains a B-pin drum 34. The B-pin pneumatic hose 46 is wound around the B-pin drum 34 in such a manner that the B-pin pneumatic hose 46 can be unreeled and reeled. The B-pin pneumatic hose 46 is connected with a pneumatic port 47 of the B-pin AOH booster 18. The B-pin pneumatic pipeline 44 connects an inlet port 45 of the B-pin drum 34 and one outlet port 43 of a third electromagnetic selector valve 39.

The second pneumatic path 20B includes a C-pin hose reel 30, a C-pin pneumatic hose 32, and a C-pin pneumatic pipeline 41.

The C-pin hose reel 30 is placed on a fixing-unit side (a crane turntable, for example) of the telescopic cylinder 71 (refer to FIG. 3). The C-pin hose reel 30 contains a C-pin drum 31. The C-pin pneumatic hose 32 is wound around the C-pin drum 31 in such a manner that the C-pin pneumatic hose 32 can be unreeled and reeled. The C-pin pneumatic hose 32 is connected with a pneumatic port 33 of the C-pin AOH booster 16. The C-pin pneumatic pipeline 41 connects an inlet port 42 of the C-pin drum 31 and the other outlet port 40 of the third electromagnetic selector valve 39.

The pneumatic-pressure supply/exhaust device 35 includes a pneumatic-pressure source 36, a first electromagnetic selector valve 37, a second electromagnetic selector valve 38, and the third electromagnetic selector valve 39. The pneumatic-pressure source 36, the first electromagnetic selector valve 37, the second electromagnetic selector valve 38, and the third electromagnetic selector valve 39 are connected in series with one another.

The pneumatic-pressure source 36 is an air compressor, an air dryer, or an air tank, for example. Configurations of those apparatuses are known, and thus, detailed description thereof is omitted. It is noted that as the pneumatic-pressure source 36, a pneumatic-pressure source dedicated to the expansion/contraction mechanism may be provided or alternatively, a pneumatic-pressure source used in a vehicle brake of the mobile crane may be utilized.

The first electromagnetic selector valve 37 is a three-port two-position selector valve, and selects either supply of a pneumatic pressure to the B/C-pin-cylinder hydraulic-pressure supply unit S, or evacuation of the B/C-pin-cylinder hydraulic-pressure supply unit S.

The second electromagnetic selector valve 38 is a two-port two-position selector valve, and selects either supply of a pneumatic pressure to the B/C-pin-cylinder hydraulic-pressure supply unit S, or holding of a pneumatic pressure in the B/C-pin-cylinder hydraulic-pressure supply unit S.

The third electromagnetic selector valve 39 is a three-port two-position selector valve, and selects either the C-pin AOH booster 16 (second pneumatic path 20B) or the B-pin AOH booster 18 (first pneumatic path 20A) as a destination of supply.

By control of operations of those electromagnetic selector valves 37, 38, and 39, a hydraulic pressure is supplied to the B-pin cylinder 5 and the C-pin cylinder 7.

One outlet port 40 of the third electromagnetic selector valve 39 is connected with the inlet port 42 of the C-pin drum 31 via the C-pin pneumatic pipeline 41. On the other hand, the other outlet port 43 of the third electromagnetic selector valve 39 is connected with the inlet port 45 of the B-pin drum 34 via the B-pin pneumatic pipeline 44.

As described above, according to the first embodiment, the electromagnetic selector valves 37 to 39 which are placed in the telescopic-cylinder movable portion 3 in the conventional configuration are relocated to a fixing-unit side of the telescopic cylinder 71.

A telescopic-cylinder fixing-unit side is nearer to a turntable and lower in level than the telescopic-cylinder movable portion 3, and surrounding obstacles on that are few. Since the electromagnetic selector valves 37 to 39 are placed on a fixing-unit side of the telescopic cylinder 71 in the first embodiment, it is possible to easily make an access to the electromagnetic selector valves 37 to 39 at a time of breakdown, which results in increased ease of maintenance.

Figure 2:
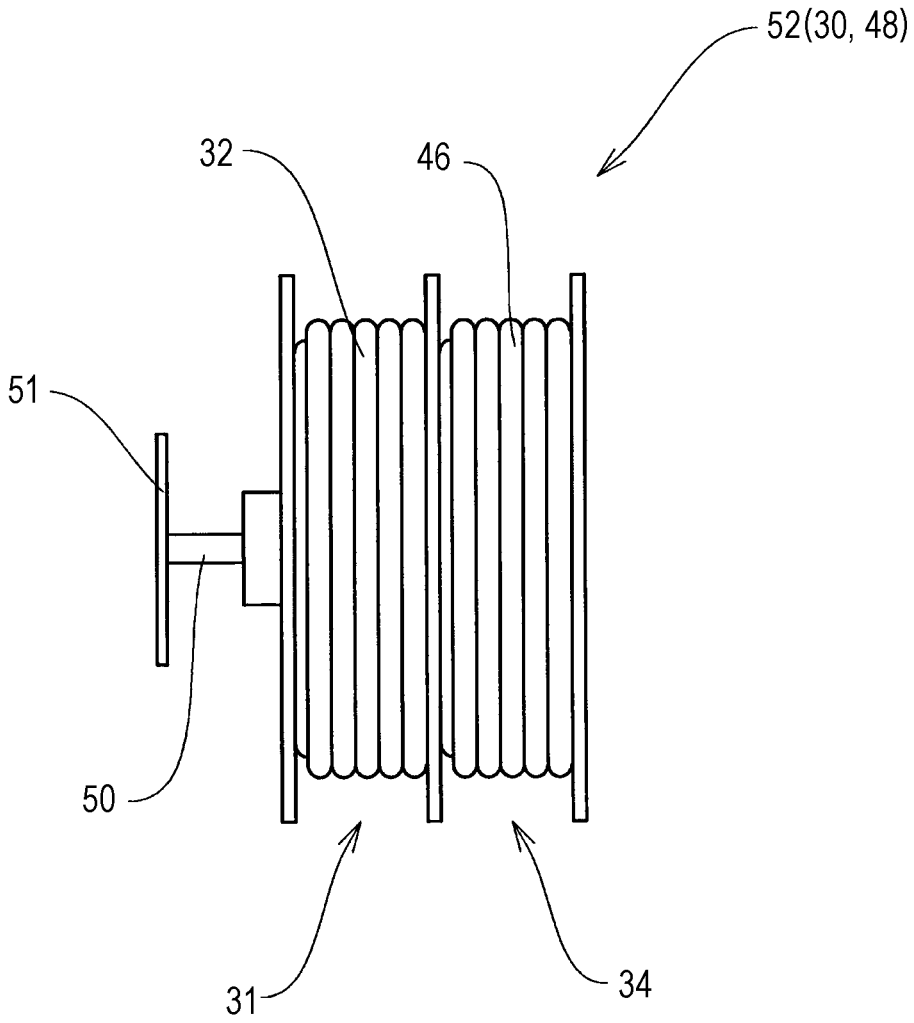
FIG. 2 is a view showing an example of a B-pin hose reel and a C-pin hose reel according to the first embodiment.

With reference to FIG. 2, a configuration of the B-pin hose reel 48 and the C-pin hose reel 30 according to the first embodiment will be described. FIG. 2 is a view showing an example of the B-pin hose reel 48 and the C-pin to hose reel 30. In FIG. 2, the B-pin hose reel 48 and the C-pin hose reel 30 are formed of the same reel member 52 (which will hereinafter be referred to as a "hose reel 52").

Around a supporting shaft 50 of the hose reel 52, the C-pin drum 31 and the B-pin drum 34 are placed coaxially with each other so as to be rotatable. The C-pin drum 31 and the B-pin drum 34 may be formed integrally with each other, or alternatively may be configured so as to rotate independently of each other.

The C-pin pneumatic hose 32 is wound around the C-pin drum 31 in such a manner that the C-pin pneumatic hose 32 can be unreeled and reeled. The B-pin pneumatic hose 46 is wound around the B-pin drum 34 in such a manner that the B-pin pneumatic hose 46 can be unreeled and reeled.

The hose reel 52 includes a plate-shaped mounting unit 51 provided with a bolt hole by which the hose reel 52 is mounted onto a turntable. One end of the supporting shaft 50 is fixed to the mounting unit 51. Inside the C-pin drum 31 and the B-pin drum 34, known impelling means such as a helical spring which impels the C-pin pneumatic hose 32 and the B-pin pneumatic hose 46 to a reeling side, is contained.

In an extending process, the C-pin pneumatic hose 32 and the B-pin pneumatic hose 46 are unreeled from the hose reel 52 along with extension of the telescopic cylinder 71 (refer to FIG. 3). In a contracting process, the C-pin pneumatic hose 32 and the B-pin pneumatic hose 46 are reeled on the hose reel 52 due to an impelling force of the impelling means.

In this manner, in the hose reel 52 of the first embodiment, the two drums 31 and 34 are placed coaxially with each other so as to be rotatable, so that a whole of the hose reel 52 can be configured in a compact fashion.

With reference to FIG. 3, an overall configuration of the expansion/contraction mechanism according to the first embodiment will be described. FIG. 3 is a cross-sectional view showing an overall configuration of the expansion contraction mechanism according to the first embodiment. In FIG. 3, a base portion of the expansion/contraction mechanism which is mounted onto the six-stage telescopic boom 60 and is in a state of fully contracting is shown in a cross section taken along a lengthwise direction of the telescopic cylinder 71.

As shown in FIG. 3, the telescopic boom 60 includes a base boom 61 inside which intermediate booms 62 to 65 (a second boom 62, a third boom 63, a fourth boom 64, and a fifth boom 65 in an order starting from an outer side) and a top boom 66 are telescopically fitted into one another individually.

The telescopic cylinder 71 includes a cylinder tube 72, a cylinder-tube rod-side end 73, a rod 74, and a rod end 75. The telescopic cylinder 71 is internally mounted onto the telescopic boom 60. The rod end 75 of the telescopic cylinder 71 is pivotably supported by a base portion 61*a* of the base boom 61 via a pin 67. Also, the telescopic boom 60 (base boom 61) is pivotably supported by a turntable 76 via a pin 77 so as to be projectable. The cylinder tube 72 forms the telescopic-cylinder movable portion 3. In the cylinder tube 72, the C-pin AOH booster 16 and the B-pin AOH booster 18 are placed.

The hose reel 52 is placed in the turntable 76, and the C-pin pneumatic hose 32 and the B-pin pneumatic hose 46 can be unreeled from, and reeled on, the hose reel 52. The C-pin pneumatic hose 32 and the B-pin pneumatic hose 46 are connected with the C-pin AOH booster 16 and the B-pin AOH booster 18 which are placed in the cylinder tube 72 (telescopic-cylinder movable portion 3), respectively, via hose guides 78 and 79.

In this manner, the expansion/contraction mechanism according to the first embodiment includes the single telescopic cylinder 71 which is internally mounted onto the telescopic boom 60 in which a plurality of booms including the base boom 61, the intermediate booms 62 to 65, and the top boom 66 are telescopically fitted and inserted into one another individually, and has one end which is pivotably supported by a base portion of the base boom 61.

Figure 4:
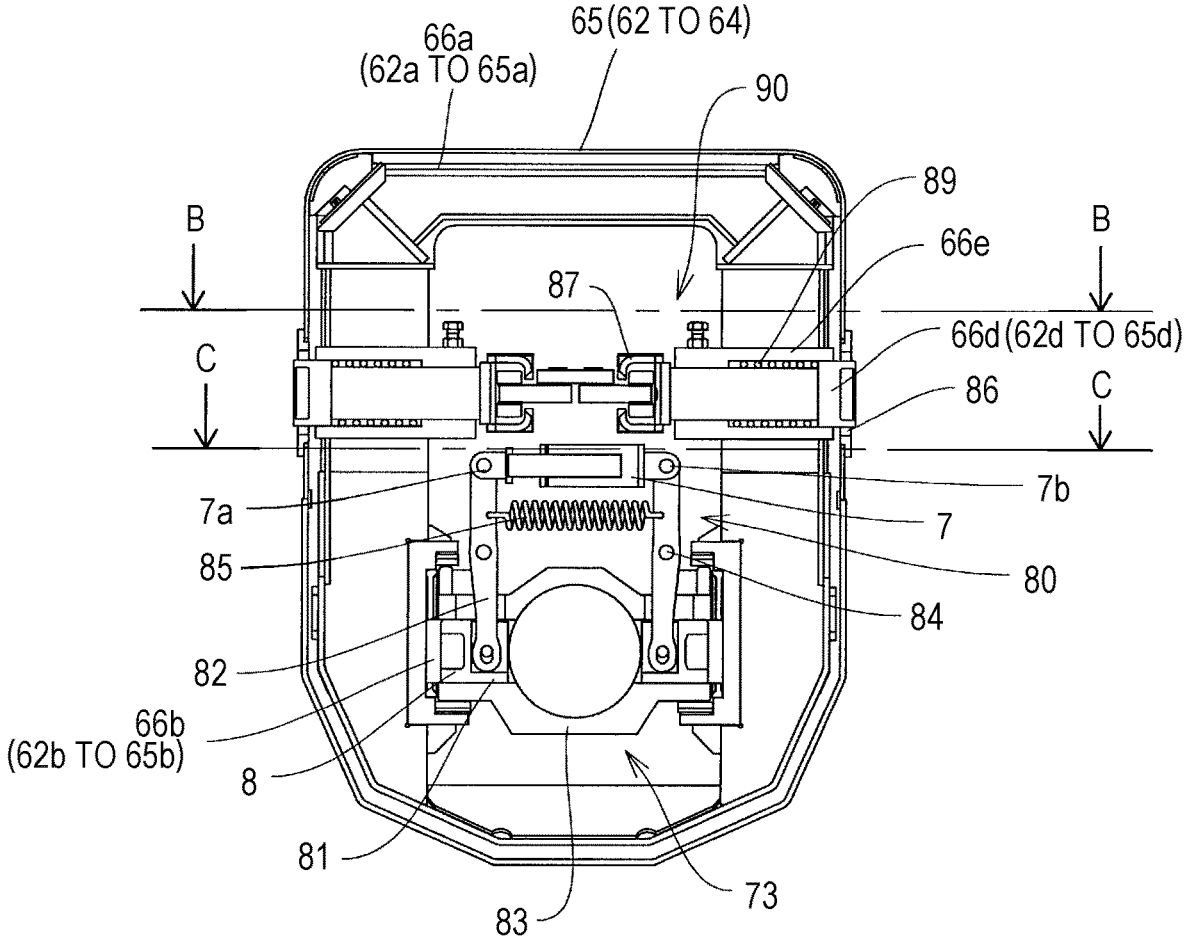
FIG. 4 is a cross-sectional view taken along A-A in FIG. 3.

With reference to FIG. 4, the cylinder-boom connecting means 80 in the expansion/contraction mechanism will be described. FIG. 4 is a cross-sectional view taken along A-A in FIG. 3. FIG. 4 provides illustration regarding a case where the cylinder-boom connecting means 80 is positioned in a connecting hole 66*b* provided in a top-boom base portion 66*a*. It is noted that like the top-boom base portion 66*a*, a second-boom base portion 62*a*, a third-boom base portion 63*a*, a fourth-boom base portion 64*a*, and a fifth-boom base portion 65*a* are provided with connecting holes 62*b*, 63*b*, 64*b*, and 65*b* (hidden line), respectively, as shown in FIG. 3.

As shown in FIG. 4, the cylinder-boom connecting means 80 includes the C-pin cylinder 7, the C pin 8, the C-pin driving lever 82, and the like.

The C-pin cylinder 7 is placed in the cylinder-tube rod-side end 73. The C pin 8 is connected with the C-pin cylinder 7 via the C-pin driving lever 82. The C pin 8 is slidably installed in a C-pin housing hole 81 of a trunnion member 83 which forms the cylinder-tube rod-side end 73, and can be inserted into, and removed from, the connecting holes 62*b* to 66*b* (connecting hole 66*b* provided in the top-boom base portion 66*a* in FIG. 4) which are placed in the boom base portions 62*a* to 66*a*.

Each of the C pin 8 and the C-pin driving lever 82 is placed in such a manner that a pair of right and left portions thereof are opposite to each other. The C-pin driving lever 82 is pivotably supported by a support (not shown) which is formed integrally with the trunnion member 83 above the trunnion member 83, via a pin 84, and can swing. One end of the C-pin driving lever 82 is pivoted to the C pin 8, and the other end is pivoted to a rod-side end 7*a* and a cylinder-side end 7*b* of the C-pin cylinder 7. The right and left portions of the C-pin driving lever 82 are connected by a tensile coil spring 85. As shown in FIG. 4, the C pin 8 is impelled to a connection side by the tensile coil spring 85 via the C-pin driving lever 82.

Figure 5:
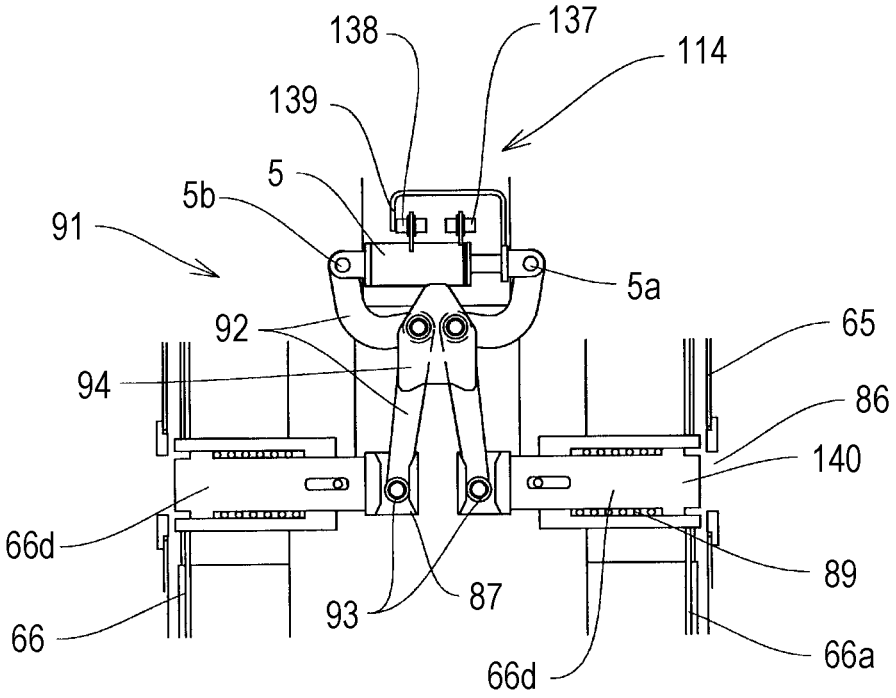
FIG. 5 is a view as seen in a direction of an arrow B-B in FIG. 4.

With reference to FIGS. 4 and 5, the boom fixing means 90 in the expansion/contraction mechanism will be described. FIG. 4 is a cross-sectional view taken along A-A in FIG. 3. FIG. 5 is a view as seen in a direction of an arrow B-B in FIG. 4. In FIGS. 4 and 5, the boom fixing means 90 in a portion where the top boom 66 and the fifth boom 65 are fixed to each other is shown.

As shown in FIGS. 4 and 5, the boom fixing means 90 includes B-pin driving means 91, a B pin 66*d*, and the like.

The B pin 66*d* is a fixing pin for fixing the top boom 66 and the fifth boom 65, and is placed in such a manner that a pair of right and left portions thereof are opposite to each other. It is noted that a B pin 62*d* of the second boom, a B pin 63*d* of the third boom, a B pin 64*d* of the fourth boom, and a B pin 65*d* of the fifth boom are similarly placed in the second-boom base portion 62*a*, the third-boom base portion 63*a*, the fourth-boom base portion 64*a*, and the fifth-boom-base portion 65*a*, respectively, in such a manner that each pair of right and left portions thereof are opposite to each other (refer to FIG. 3).

The fifth boom 65 includes a fixing hole 86 into which the B pin 66*d* is inserted, in a side surface thereof. The fixing hole 86 is provided in a plurality of positions along a lengthwise direction, in accordance with an extension length of the top boom 66. Regarding provision of a fixing hole, the other booms (the base boom 61, the second boom 62, the third boom 63, and the fourth boom 64) are configured in a basically similar fashion.

It is noted that although the B pins corresponding to the respective booms are denoted by the reference signs 62*d* to 66*d* in the description of an overall configuration of the expansion/contraction mechanism, each of the B pins is identical to the B pin 4 shown in FIG. 1. That is, in FIG. 1, only a B pin for a one-stage boom is shown with a view to giving an overview of the B/C-pin cylinder hydraulic circuit 10.

The B pin 66*d* is slidably installed in a B-pin housing member 66*e* of the top-boom base portion 66*a*, and can be inserted into, and removed from, the fixing hole 86 provided in a side surface of the fifth boom 65. The B pin 66*d* is impelled to a fixing side by a compression coil spring 89 placed on an outer surface of the B pin 66*d*. The B pin 66*d* includes a connecting member 87 in an inner end thereof. The connecting member 87 is shaped like a box which is partially opened, and is connectable with the B-pin driving lever 92 via a roller 93 of the B-pin driving means 91.

The B-pin driving means 91 includes the B-pin cylinder 5, the B-pin driving lever 92, and the roller 93.

The B-pin driving lever 92 is pivotably supported by a support 94 which is provided in the cylinder-tube rod-side end 73 (telescopic-cylinder movable portion 3) so as to be swingable, and is placed in such a manner that a pair of right and left portions thereof are opposite to each other. The roller 93 is rotatably and pivotably supported at one end of the B-pin driving lever 92, and each of a rod-side end 5*a* and a cylinder-side end 5*b* of the B-pin cylinder 5 is pivoted to the other end of the B-pin driving lever 92. FIG. 5 shows a state in which the roller 93 is fitted into the connecting member 87 and the B pin 66*d* of the top boom 66 and the B-pin driving means 91 are connected.

A whole of the B-pin driving means 91 is configured integrally with the cylinder-tube rod-side end 73 shown in FIG. 3. Thus, the B-pin driving means 91 can cause the roller 93 to be positioned in the connecting member 87 of an arbitrary B pin out of the B pins 62*d* to 66*d* placed in the base portions 62*a* to 66*a* of the respective booms, by virtue of a telescoping operation of the telescopic cylinder 71, to thereby drive the arbitrary B pin. The connecting member 87 provided in an inner end of each of the B pins 62*d* to 66*d* is shaped like a box which is partially opened, so that, at the time of a telescoping operation of the telescopic cylinder 71, the B-pin driving lever 92 passes by an opened portion of the connecting member 87 of each of B pins which are not objects being driven.

Figure 6:
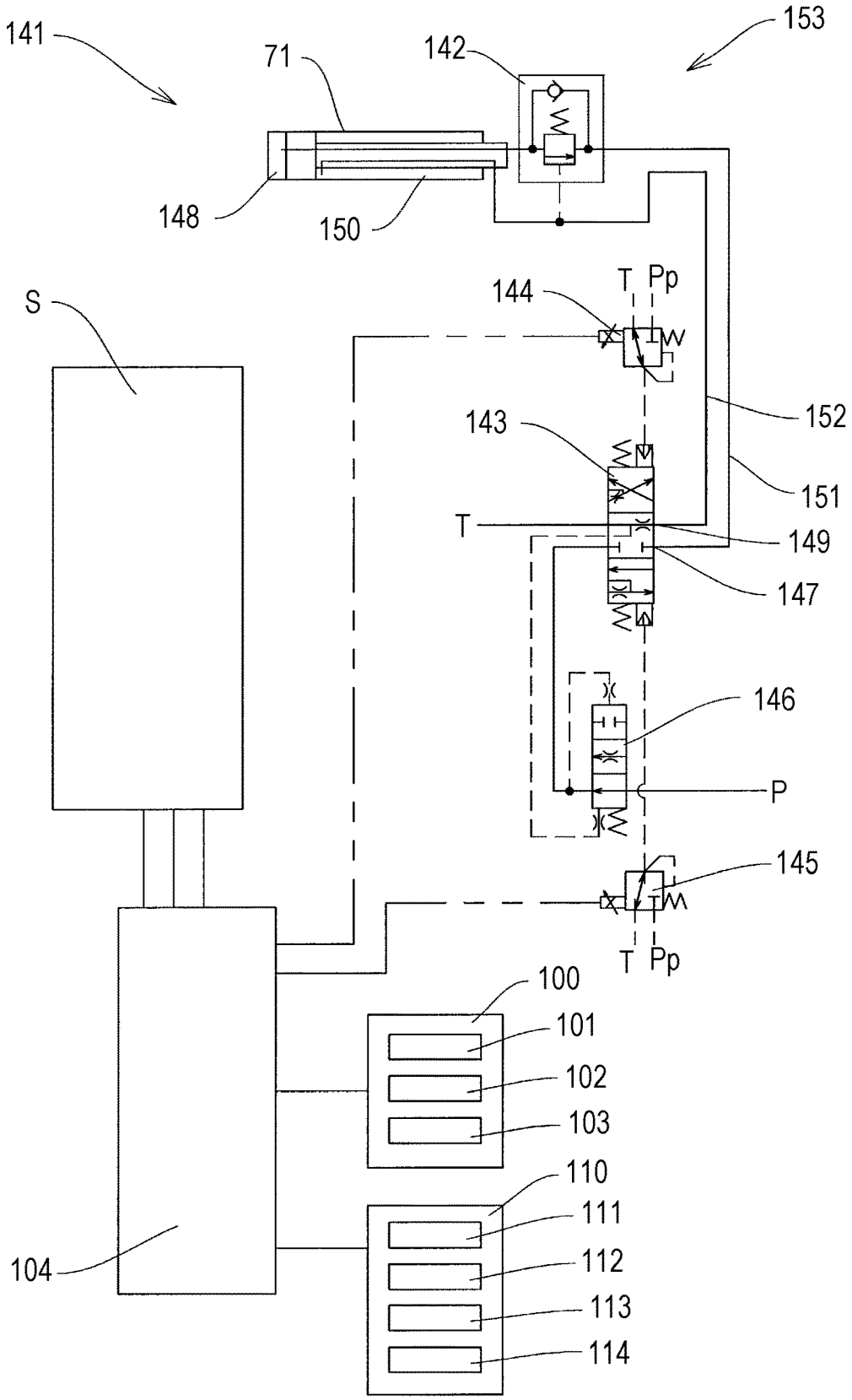
FIG. 6 is a view showing examples of control blocks and a hydraulic circuit of the expansion/contraction mechanism according to the first embodiment.

With reference to FIG. 6, a telescoping operation of the telescopic boom 60 will be described. FIG. 6 is a view showing examples of control blocks and a hydraulic circuit of the expansion/contraction mechanism according to the first embodiment.

As shown in FIG. 6, the expansion/contraction mechanism includes expansion/contraction-mechanism operating means 100, telescoping-state detecting means 110, a controller 104, and hydraulic-pressure supply means 141.

The expansion/contraction-mechanism operating means 100 includes a telescoping operation lever 101, final-boom-state input means 102, and telescoping-related-information display means 103. The expansion/contraction-mechanism operating means 100 is placed in a crane cab 115, for example.

The telescoping operation lever 101 converts an operation direction and an operation amount of a lever in a telescoping operation, into an electric signal, and outputs the electric signal to the controller 104. The final-boom-state input means 102 inputs a desired extension state (final boom state) which is supposed to be provided after a telescoping operation, in telescoping the to boom 60. The final-boom-state input means 102 is operated in conjunction with the telescoping-related-information display means 103 which will be later described. An operation signal of the final-boom-state input means 102 is output to the controller 104. The telescoping-related-information display means 103 graphically displays information related to an operation of the expansion/contraction mechanism in accordance with a display control signal provided from the controller 104.

FIG. 7 shows an example of a display screen provided by the telescoping-related-information display means 103. What is displayed on a display screen is changeable. On a display screen, boom requirements for telescoping the telescopic boom 60 are displayed. Each of boom requirements indicates a boom state which is observed after extension of the telescopic boom 60, and associates an extension length 105 of the telescopic boom 60 with an extension proportion 106 of a boom of each stage. On a display screen, a plurality of boom requirements are displayed, and it is possible to select a desired boom requirement by moving a box-shaped cursor 107 upward and downward through an operation on a forward/backward key of the final-boom-state input means 102. For example, by moving the box-shaped cursor 107 to a row corresponding to a desired boom requirement and performing there an operation on a set key of the final-boom-state input means 102, it is possible to allow a boom requirement to be input to the controller 104. In FIG. 7, a selected boom requirement is indicated by a circle 108.

The telescoping-state detecting means 110 includes the following specific detecting means. That is, the telescoping-state detecting means 110 includes boom-base-position detecting means 111, cylinder-length detecting means 112, C-pin-state detecting means 113, and B-pin-state detecting means 114.

The boom-base-position detecting means 111 detects a boom in which the cylinder-boom connecting means 80 is positioned at a base thereof, and outputs a detection signal to the controller 104.

The cylinder-length detecting means 112 detects a cylinder length of the telescopic cylinder 71, and outputs a detection signal to the controller 104. The controller 104 reads out a telescoping length within specifications set in accordance with a position of a fixing hole of the boom fixing means 90, based on a detection value of the cylinder-length detecting means 112, and treats the extension length within specifications as an extension length for a boom telescoping process.

The C-pin-state detecting means 113 detects a state of the C pin 8 which is driven by the cylinder-boom connecting means 80, and outputs a detection signal to the controller 104.

The B-pin-state detecting means 114 detects a state of any of the B pins 62*d* to 66*d* which is driven by the B-pin driving means 91, and outputs a detection signal to the controller 104.

Figure 8:
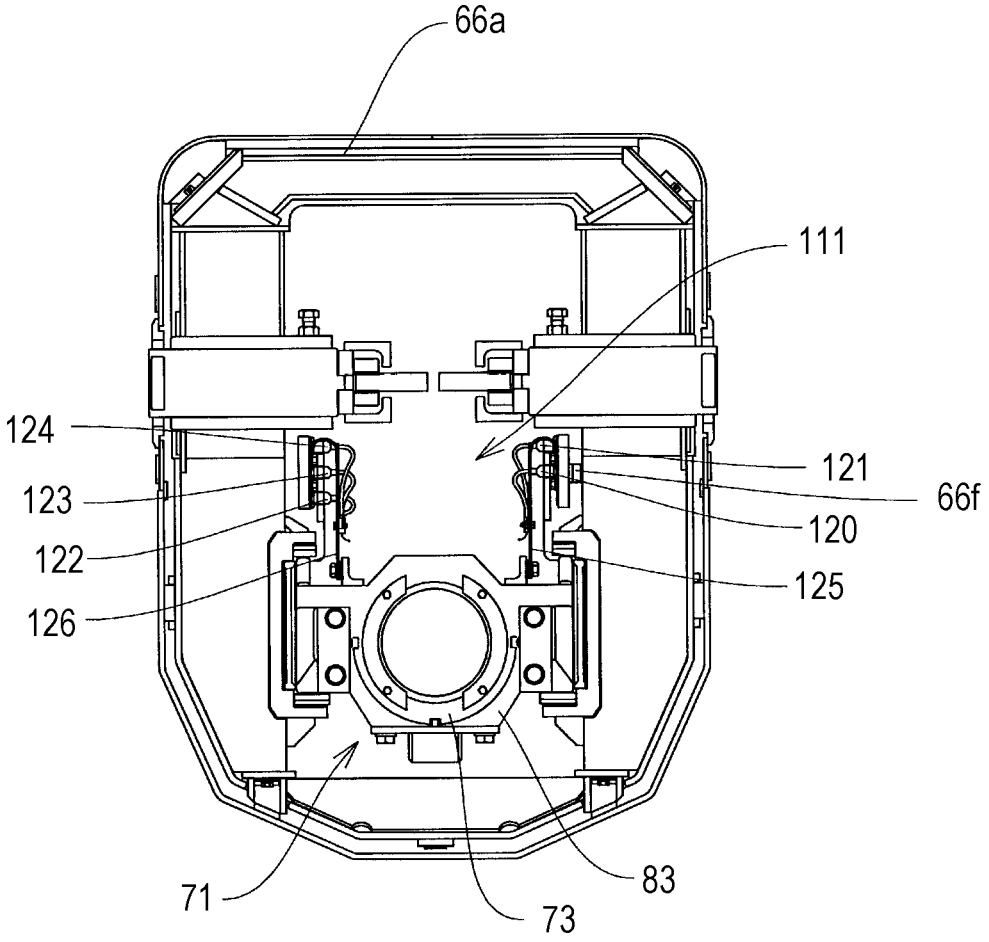
FIG. 8 shows a specific example of boom-base-position detecting means, and is a view as seen in a direction of an arrow D-D in FIG. 3.

FIG. 8 shows a specific example of the boom-base-position detecting means 111. FIG. 8 is a view as seen in a direction of an arrow D-D in FIG. 3. In an example shown in FIG. 8, the boom-base-position detecting means 111 includes proximity switches 120 to 124.

The proximity switches 120 to 124 are mounted onto the cylinder-tube rod-side end 73 (trunnion member 83) of the telescopic cylinder 71 via supports 125 and 126. A detection piece 66*f* is attached to the top-boom base portion 66*a* in a position where the piece 66*f* faces the proximity switch 120. FIG. 8 shows a state where the proximity switch 120 detects the detection piece 66*f* on the top-boom base portion 66*a*.

Similarly, in the base portions 65*a* to 62*a* of the other booms, detection pieces 62*f* to 65*f* are provided in positions where the pieces 62*f* to 65*f* face the proximity switches 121 to 124, respectively. It can be determined which boom is connected with the C pin 8 of the cylinder-boom connecting means 80 via a connecting hole, depending on which of the proximity switches 120 to 124 detects any of the detection pieces 62*f* to 66*f*.

The cylinder-length detecting means 112 includes a length detector 130 which is mounted onto the base-boom base portion 61*a* on a fixing-unit side of the telescopic cylinder 71, for example (refer to FIG. 3). A code drawn from the length detector 130 is connected with a support of the cylinder-tube rod-side end 73 of the telescopic cylinder 71. It is designed such that the code is drawn from, and put into, the length detector 130 along with a telescoping operation of the telescopic cylinder 71, and a cylinder length of the telescopic cylinder 71 is detected from an amount of drawing of the code.

Figure 9:
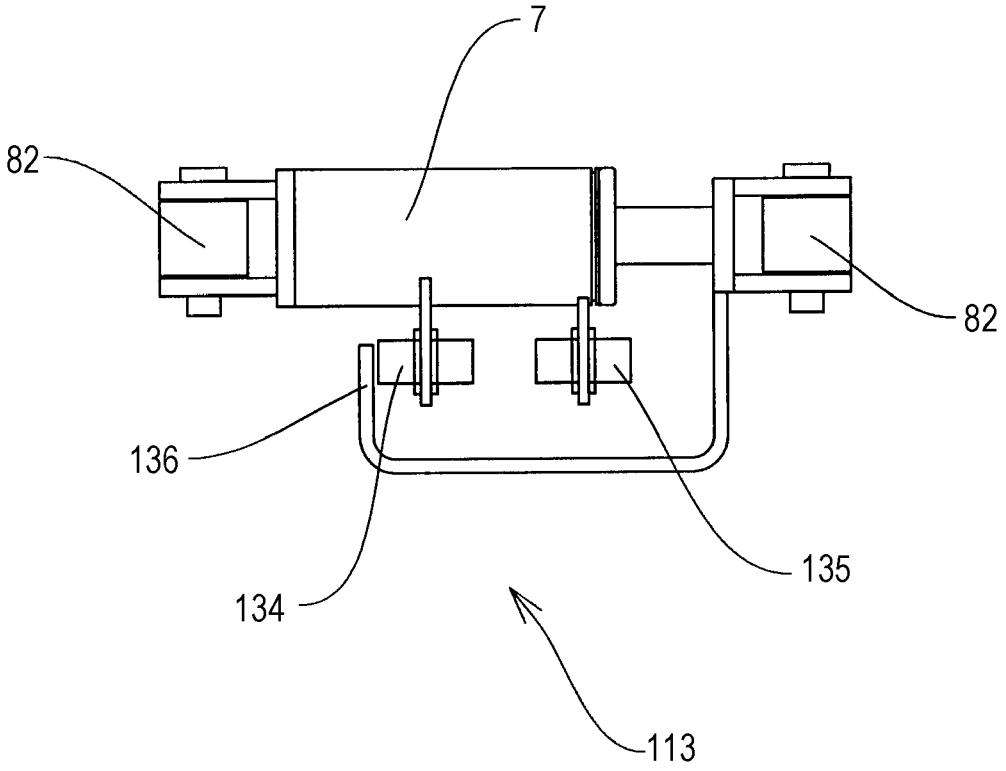
FIG. 9 is a view as seen in a direction of an arrow C-C in FIG. 4.

FIG. 9 shows a specific example of the C-pin-state detecting means 113. FIG. 9 is a view as seen in a direction of an arrow C-C in FIG. 4. In an example shown in FIG. 9, the C-pin-state detecting means 113 includes proximity switches 134 and 135.

The proximity switches 134 and 135 are mounted onto a cylinder portion of the C-pin cylinder 7. A U-shaped detection piece 136 is attached to a rod portion of the C-pin cylinder 7. In a cylinder-disconnected state (refer to FIG. 4) in which the C pin 8 of the cylinder-boom connecting means 80 comes out of the connecting hole 66*b* of the top boom 66, the proximity switch 134 on one side detects the detection piece 136. When the C-pin cylinder 7 which is kept being in an extending state is released and a top end of the C pin 8 is inserted into the connecting hole 66*b* due to an impelling force of the tensile coil spring 85 (refer to FIG. 4), the proximity switch 135 on the other side detects the detection piece 136.

FIG. 5 shows a specific example of the B-pin-state detecting means 114. In an example shown in FIG. 5, the B-pin-state detecting means 114 includes proximity switches 137 and 138.

The proximity switches 137 and 138 are mounted onto a cylinder portion of the B-pin cylinder 5. A U-shaped detection piece 139 is attached to a rod portion of the B-pin cylinder 5. As shown in FIG. 5, in a boom-unfixed state in which a top end 140 of the B pin 66*d* of top-boom base portion 66*a* comes out of the fixing hole 86 of the fifth boom 65, the proximity switch 138 on one side detects the detection piece 139. When the B pin cylinder 5 which is kept being in an extending state is released and the B-pin cylinder 5 contracts due to an impelling force of the spring 14 (refer to FIG. 1) contained in the B-pin cylinder 5, the top end 140 of the B pin 66*d* is inserted into the fixing hole 86 due to an impelling force of the compression coil spring 89 and the proximity switch 137 on the other side detects the detection piece 139.

FIG. 6 shows a relationship between a specific hydraulic circuit of a telescopic-cylinder hydraulic-pressure supply unit 153 and the other configurations. As shown in FIG. 6, the hydraulic-pressure supply means 141 includes the telescopic-cylinder hydraulic-pressure supply unit 153 which supplies a hydraulic pressure to the telescopic cylinder 71, and the B/C-pin-cylinder hydraulic-pressure supply unit S which supplies a hydraulic pressure to the C-pin cylinder 7 of the cylinder-boom connecting means 80 and the B-pin cylinder 5 of the B-pin driving means 91. The telescopic-cylinder hydraulic-pressure supply unit 153 and the B/C-pin-cylinder hydraulic-pressure supply unit S supply hydraulic pressures to the telescopic cylinder 71, the C-pin cylinder 7, and the B-pin cylinder 5, and drive them, in accordance with a control signal provided from the controller 104.

Details of the B/C-pin-cylinder hydraulic-pressure supply unit S are as described above with reference to FIG. 1, and so, now, a configuration of the telescopic-cylinder hydraulic-pressure supply unit 153 will be described.

The telescopic-cylinder hydraulic-pressure supply unit 153 includes a counterbalance valve 142, a pilot-type selector valve 143, electromagnetic proportional valves 144 and 145, and a flow control valve 146.

A pump port of the pilot-type selector valve 143 is connected with a hydraulic-pressure source P via the flow control valve 146. Also, a tank port of the pilot-type selector valve 143 is connected with a tank T.

The electromagnetic proportional valves 144 and 145 are proportionally controlled by a control signal provided from the controller 104. It is designed such that the pilot-type selector valve 143 is switched depending on an output pilot pressure of each of the electromagnetic proportional valves 144 and 145.

A first outlet port 147 of the pilot-type selector valve 143 and an extension-side fluid chamber 148 of the telescopic cylinder 71 communicate with each other by means of a hydraulic pipeline 151 via the counterbalance valve 142. Also, a second outlet port 149 of the pilot-type selector valve 143 and a contraction-side fluid chamber 150 of the telescopic cylinder 71 communicate with each other by means of a hydraulic pipeline 152.

Operations of the expansion/contraction mechanism according to the present embodiment will be described with reference to FIGS. 1 to 6, taking an extending operation of the expansion/contraction mechanism, which is performed from a state where the six-stage telescopic boom 60 fully contracts (refer to FIG. 3) to a state where the top boom 66 and the fifth boom 65 extend (refer to FIG. 10), as an example.

At a starting time of an extending operation, the telescopic boom 60 is placed in a fully-contracting state as shown in FIG. 3. At that time, the cylinder-boom connecting means 80 is connected with the base portion 66*a* of the top boom 66. All of pairs of adjacent booms are fixed by the boom fixing means 90. Also, the B-pin driving means 91 is connected with the B pin 66*d* of the top boom 66.

First, an operator selects a boom requirement on a display screen of the telescoping-related-information display means 103 by operating a forward/backward key of the final-boom-state input means 102. When an operator selects a boom requirement No. 5 that the top boom (the sixth stage) extends by 93% and the fifth boom (the fifth stage) extends by 93% (refer to FIG. 7), and operates a set key of the final-boom-state input means 102, the selected boom requirement is output to the controller 104, and is stored.

Subsequently, when an operator operates the telescoping operation lever 101 toward an extension side and maintains that state, the controller 104 exerts automatic control over the expansion/contraction mechanism such that the mechanism continues performing an extending operation by repetition of a cycle including the following processes until the boom requirement. No. 5 as set is satisfied. More specifically, in one cycle, a boom unfixing process, a boom telescoping process (a boom extending process in this case), a boom fixing process, a cylinder-boom disconnecting process, a telescopic-cylinder contracting process, and a cylinder-boom connecting process are sequentially performed. It is noted that if an operator returns the telescoping operation lever 101 to a neutral position at some midpoint in a telescoping operation, the controller 104 stops operations of the expansion/contraction mechanism at that point of time.

(Boom Unfixing Process)

In a boom unfixing process, the controller 104 outputs a control signal which gives instructions for pulling the B pin 66*d* of the top boom 66, out of the fifth boom 65 (for causing the B-pin cylinder 5 to extend), to the B/C-pin-cylinder hydraulic-pressure supply unit S (pneumatic-pressure supply/exhaust device 35), in accordance with an operator's operation on the telescoping operation lever 101. More specifically, the controller 104 outputs a control signal which turns on energization of the first electromagnetic selector valve 37, turns off energization of the second electromagnetic selector valve 38, and turns on energization of the third electromagnetic selector valve 39.

As a result of this, a pneumatic pressure of the pneumatic-pressure source 36 is supplied to the first pneumatic path 20A, passing through the first electromagnetic selector valve 37, the second electromagnetic selector valve 38, and the third electromagnetic selector valve 39, and is further supplied to the B-pin AOH booster 18. The supplied pneumatic pressure is converted to a hydraulic pressure by the B-pin AOH booster 18. The hydraulic pressure resulted from conversion is supplied to the B-pin cylinder 5 via the hydraulic pipeline 15. Then, the B-pin cylinder 5 is driven toward an extension side while compressing the spring 14 contained therein, to retract the B pin 4 to a release side.

FIG. 5 shows a state where the B-pin driving lever 92 is moved to a release side as a result of extension of the B-pin cylinder 5, and the B pin 66*d* of the top boom 66 recedes against an impelling force of the compression coil spring 89 and is pulled out of the fixing hole 86. The controller 104 recognizes that unfixing of booms is finished, based on a detection signal provided from the proximity switch 138 forming the B-pin-state detecting means 114.

The controller 104 outputs a control signal which turns off energization of the first electromagnetic selector valve 37, turns on energization of the second electromagnetic selector valve 38, and turns on energization of the third electromagnetic selector valve 39. As a result of this, a pneumatic pressure is held in the first pneumatic path 20A between the second electromagnetic selector valve 38 and the B-pin AOH booster 18. The B-pin cylinder 5 keeps itself in an extending state, and the B pin 66*d* is kept being pulled out.

In this manner, the top-boom base portion 66*a* and the fifth boom 65 are unfixed. After a boom unfixing process is finished, a shift to a subsequent boom extending process is made.

A pipeline between the pneumatic-pressure source 36 placed on a telescopic-cylinder fixing-unit side (crane turntable 76, for example) and the B-pin AOH booster 18 is very long. Nonetheless, since a working fluid is a pneumatic pressure, the pipeline is hardly affected by a change in viscosity due to temperature reduction. Also, since the hydraulic pipeline 15 between the B-pin AOH booster 18 and the B-pin cylinder 5 is very short, the hydraulic pipeline 15 is hardly affected by a change in viscosity due to temperature reduction. As a consequence, extremely excellent responsiveness is attained in a boom unfixing process.

(Boom Extending Process)

In a boom extending process, the controller 104 outputs a control signal which gives instructions for causing the telescopic cylinder 71 to extend, to the telescopic-cylinder hydraulic-pressure supply unit 153. More specifically, the controller 104 outputs a control signal to the electromagnetic proportional valve 145 so that a pilot pressure proportional to an amount of operation performed on the to operation lever 101 can be applied to the pilot-type selector valve 143. The pilot-type selector valve 143 is connected with the hydraulic-pressure source P, and a hydraulic pressure from the hydraulic-pressure source P is fed to an extension-side fluid chamber 148 of the telescopic cylinder 71, passing through the hydraulic pipeline 151 and the counterbalance valve 142. As a result of this, the telescopic cylinder 71 extends, to cause the top boom 66 to extend.

In a boom extending process, the controller 104 determine s whether or not the B pin 66*d* of the top boom 66 connected with the B-pin driving means 91 gets near to an extension-time deceleration starting point which is at a predetermined distance from a target fixing hole of the fifth boom 65, based on a detection signal provided from the cylinder-length detecting means 112. If the controller 104 determines that the B pin 66*d* gets near to the extension-time deceleration starting point, the controller 104 outputs a telescopic-cylinder deceleration signal to the telescopic-cylinder hydraulic-pressure supply unit 153.

More specifically, in a boom extending process, the cylinder-length detecting means 112 continues feeding a detection signal indicating a length of the telescopic cylinder 71, to the controller 104. When the controller 104 detects that the B pin 66*d* reaches the extension-time deceleration starting point, the controller 104 starts reducing a value of an output signal being provided to the electromagnetic proportional valve 145. Then, a pilot pressure which is applied to the pilot-type selector valve 143 by the electromagnetic proportional valve 145 is reduced, so that a spool of the pilot-type selector valve 143 is returned back. By reduction of an opening area of the first outlet port 147, a flow rate of a passing working fluid is reduced. This reduces an extension speed of the telescopic cylinder 71. Then, when the controller 104 determines that the B pin 66*d* of the top boom 66 reaches a position of a target fixing hole, the controller 104 stops an extending operation of the telescopic cylinder 71. After a boom extending process is finished, a shift to a subsequent boom fixing process is made.

(Boom Fixing Process)

In a boom fixing process, the controller 104 outputs a control signal which gives instructions for inserting the B pin 66*d* of the top boom 66 into the fifth boom 65 (for causing the B-pin cylinder 5 to contract), to the B/C-pin-cylinder hydraulic-pressure supply unit S. More specifically, the controller 104 outputs a control signal which turns off energization of the first electromagnetic selector valve 37 of the pneumatic-pressure supply/exhaust device 35, turns off energization of the second electromagnetic selector valve 38 of the device 35, and turns on energization of the third electromagnetic selector valve 39 of the device 35.

As a result of this, a pneumatic pressure which is held between the second electromagnetic selector valve 38 and the B-pin AOH booster 18 is released to the atmosphere via a pneumatic-pressure release port of the first electromagnetic selector valve 37. Also, a working fluid which is supplied to a fluid chamber of the B-pin cylinder 5 is returned back to the B-pin AOH booster 18 via the hydraulic pipeline 15. The B pin cylinder 5 contracts due to an impelling force of the spring 14 contained therein, so that the B pin 4 is moved to a fixing side due to an impelling force of the spring 13.

To explain operations with reference to FIG. 5, the B-pin driving lever 92 swings along with contraction of the B-pin cylinder 5, so that the B pin 66*d* is moved to a fixing side via the roller 93. By insertion of the B pin 66*d* of the top boom 66 into the fixing hole 86 of the fifth boom 65, the top-boom base portion 66*a* is fixed to the fifth boom 65. The controller 104 recognizes that booms are fixed to each other, based on a detection signal provided from the proximity switch 137.

In this manner, the top-boom base portion 66*a* and the fifth boom 65 are fixed to each other. After a boom fixing process is finished, a shift to a subsequent cylinder-boom disconnecting process is made.

Also in a boom fixing process, a pneumatic pipeline between the first electromagnetic selector valve 37 and the B-pin AOH booster 18 is very long. Nonetheless, since a working fluid is a pneumatic pressure, an operational delay at a low temperature is shorter by far than that in a case where a working fluid is a hydraulic pressure. Also, since the hydraulic pipeline 15 between the B-pin AOH booster 18 and the B-pin cylinder 5 is very short, an operational delay related thereto is not serious. As a consequence, extremely excellent responsiveness is attained also in a boom fixing process (Cylinder-Boom Disconnecting Process)

Further, as the telescoping operation lever 101 continues being operated toward an extension side, a cylinder-boom disconnecting process is performed. The controller 104 outputs a control signal which gives instructions for disconnecting the C pin 8 and the top boom 66, to the B/C-pin-cylinder hydraulic-pressure supply unit S. More specifically, the controller 104 outputs a control signal which turns on energization of the first electromagnetic selector valve 37 of the pneumatic-pressure supply/exhaust device 35, turns off energization of the second electromagnetic selector valve 38 of the device 35, and turns off energization of the third electromagnetic selector valve 39 of the device 35.

As a result of this, a pneumatic pressure of the pneumatic-pressure source 36 is supplied to the second pneumatic path 20B, passing through the first electromagnetic selector valve 37, the second electromagnetic selector valve 38, and the third electromagnetic selector valve 39, and is further supplied to the C-pin AOH booster 16. The supplied pneumatic pressure is converted to a hydraulic pressure by the C-pin. AOH booster 16. The hydraulic pressure resulted from conversion as supplied to the C-pin cylinder 7 via the hydraulic pipeline 12. Accordingly, the C-pin cylinder 7 is driven toward an extension side while compressing the tensile coil spring 85, to retract the C pin 8 to a release side.

As shown in FIG. 4, as a result of extension of the C-pin cylinder 7, the C pin 8 is pulled out of the connecting hole 66*b* of the top boom 66 via the C-pin driving lever 82. Accordingly, the cylinder-tube rod-side end 73 (telescopic-cylinder movable portion 3) of the telescopic cylinder 71 and the top-boom base portion 66*a* are disconnected. The controller 104 recognizes that the cylinder and the boom are disconnected, based on a detection signal provided from the proximity switch 134.

In this manner, the top-boom base portion 66*a* and the C pin 8 are disconnected. After a cylinder-boom disconnecting process is finished, a shift to a subsequent telescopic-cylinder contracting process is made.

Also in a cylinder-boom disconnecting process, a pipeline between the first electromagnetic selector valve 37 and the C-pin AOH booster 16 is very long. Nonetheless, since a working fluid is a pneumatic pressure, an operational delay at a low temperature is shorter by far than that in a case where a working fluid is a hydraulic pressure. Also, since the hydraulic pipeline 12 between the C-pin AOH booster 16 and the C-pin cylinder 7 is very short, an operational delay related thereto is not serious. As a consequence, extremely excellent responsiveness is attained also in a cylinder-boom disconnecting process.

(Telescopic-Cylinder Contracting Process)

In a telescopic-cylinder contracting process, the controller 104 outputs a control signal which gives instructions for causing the telescopic cylinder 71 to contract, to the telescopic-cylinder hydraulic-pressure supply unit 153. More specifically, the controller 104 outputs a control signal to the electromagnetic proportional valve 144. The pilot-type selector valve 143 is switched, so that the hydraulic-pressure source P is connected with the second outlet port 149. Then, a hydraulic pressure from the hydraulic-pressure source P is supplied to the contraction-side fluid chamber 150 of the telescopic cylinder 71 via the hydraulic pipeline 152. As result of this, the telescopic cylinder 71 starts a contracting operation independently without driving any boom.

In a telescopic-cylinder contracting process, the controller 104 determines whether or not the C pin 8 connected with C-pin driving means (of which reference sign is omitted) gets near to a contraction-time deceleration starting point which is at a predetermined distance from a connecting hole of the fifth boom 65, based on a detection signal provided from the cylinder-length detecting means 112. If the controller 104 determines that the C pin 8 gets near to the contraction-time deceleration starting point, the controller 104 outputs a telescopic-cylinder deceleration signal to the telescopic-cylinder hydraulic-pressure supply unit 153.

More specifically, in a telescopic-cylinder contracting process, the cylinder-length detecting means 112 continues feeding a detection signal indicating a length of the telescopic cylinder 71, to the controller 104. When the controller 104 detects that the C pin 8 reaches the contraction-time deceleration starting point, the controller 104 starts reducing a value of an output signal being provided to the electromagnetic proportional valve 145. Then, a pilot pressure which is applied to the pilot-type selector valve 143 by the electromagnetic proportional valve 144 is reduced, so that a spool of the pilot-type selector valve 143 is returned back. By reduction of an opening area of the second outlet port 149, a flow rate of a passing working fluid is reduced. This reduces a contraction speed of the telescopic cylinder 71. Then, when the controller 104 determines that the C pin 8 reaches a position of a connecting hole of the fifth boom 65, the controller 104 stops a contracting operation of the telescopic cylinder 71. After a telescopic-cylinder contracting process is finished, a shift to a subsequent cylinder-boom connecting process is made.

In a telescopic-cylinder contracting process, it is determined whether or not the C pin 8 reaches a target position, by a detection signal provided from the cylinder-length detecting means 112 and a detection signal provided from the boom-base-position detecting means 111. In other words, when the detection piece 65*f* provided in the fifth-boom base portion 65*a* is detected by the proximity switch 121 (refer to FIG. 8), it is determined that the C pin 8 reaches a target position.

(Cylinder-Boom Connecting Process)

In a cylinder-boom connecting process, the controller 104 outputs a control signal which gives instructions for connecting the C pin 8 and the fifth boom 65, to the B/C-pin-cylinder hydraulic-pressure supply unit S. More specifically, the controller 104 outputs a control signal which turns off energization of the first electromagnetic selector valve 37 of the pneumatic-pressure supply/exhaust device 35, turns off energization of the second electromagnetic selector valve 38 of the device 35, and turns off energization of the third electromagnetic selector valve 39 of the device 35.

As a result of this, a pneumatic pressure held between the first electromagnetic selector valve 37 and the C-pin AOH booster 16 is released to the atmosphere via a pneumatic-pressure release port of the first electromagnetic selector valve 37. Also, a working fluid which is supplied to a fluid chamber of the C-pin cylinder 7 is returned back to the C-pin AOH booster 16 via the hydraulic pipeline 12. The C-pin cylinder 7 is driven toward a contraction side due to an impelling force of the spring 11 of the C pin 8, to advance the C pin 8 toward a connection side.

FIG. 4 shows a state where the C-pin driving lever 82 is moved as a result of contraction of the C-pin cylinder 7 and the C pin 8 is inserted into the connecting hole 65*b* of the fifth-boom base portion 65*a*. By insertion of the C pin 8 into the connecting hole 65*b*, the cylinder-tube rod-side end 73 (telescopic-cylinder movable portion) of the telescopic cylinder 71 and the fifth-boom base portion 65*a* are connected. The controller 104 recognizes that the telescopic cylinder 71 and the fifth boom 65 are connected, based on a detection signal provided from the proximity switch 135 (refer to FIG. 9).

Also in a cylinder-boom connecting process, a pneumatic pipeline between the first electromagnetic selector valve 37 and the C-pin AOH booster 16 is very long. Nonetheless, since a working fluid is a pneumatic pressure, an operational delay at a low temperature is shorter by far than that in a case where a working fluid is a hydraulic pressure. Also, since the hydraulic pipeline 12 between the C-pin AOH booster 16 and the C-pin cylinder is very short, an operational delay related thereto is not serious.

Figure 10:
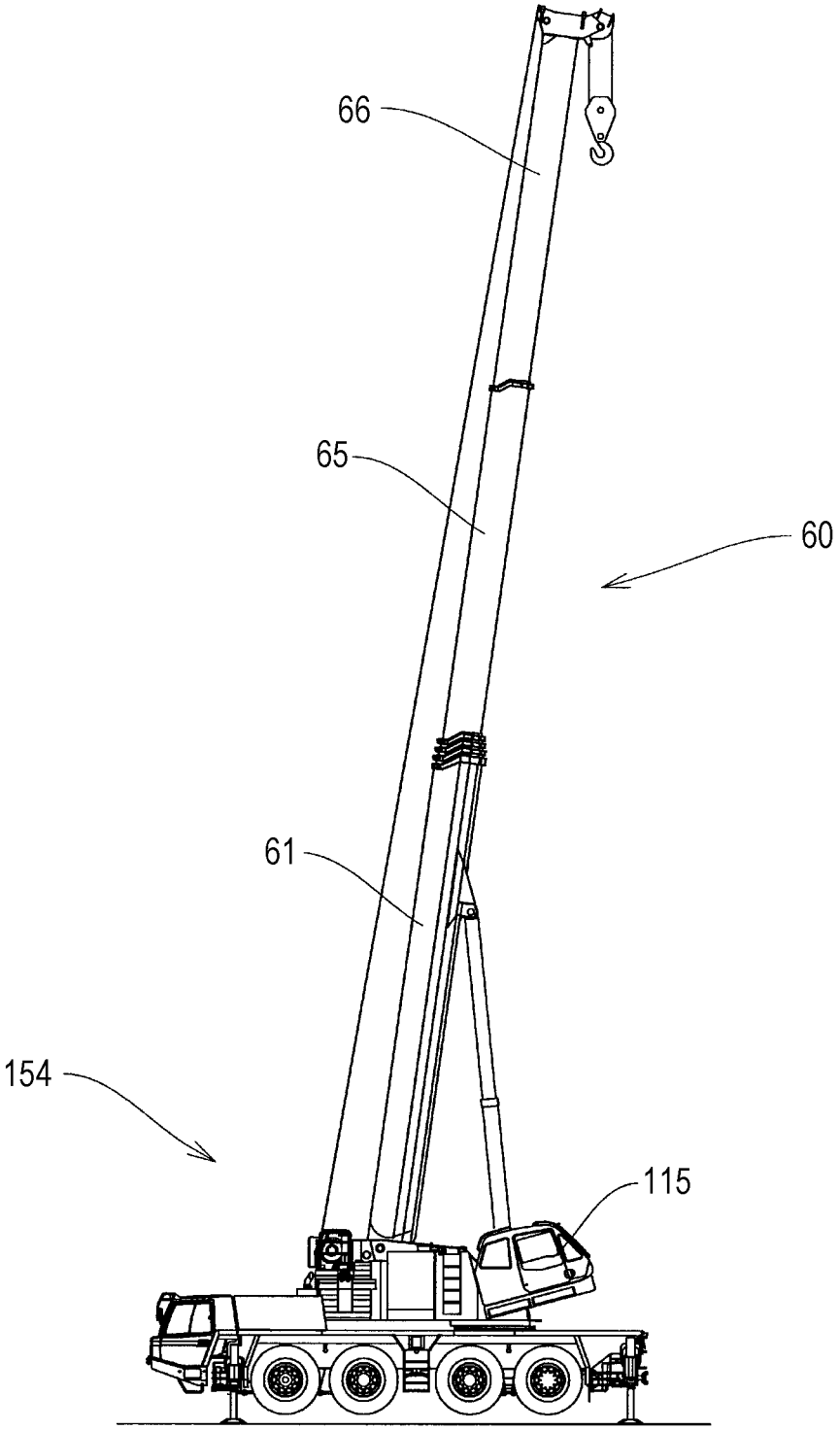
FIG. 10 is an external view of a mobile crane, showing a final boom state after a telescoping operation.

Thereafter, when the fifth boom 65 extends to be placed in a desired final boom state shown in FIG. 10 by repetition of the above-described processes, a control device of the expansion/contraction mechanism finishes operations thereof.

In this manner, the expansion/contraction mechanism according to the first embodiment includes: the single telescopic cylinder 71 internally mounted onto the telescopic boom 60 into which the plurality of booms 61 to 66 including the base boom 61, the intermediate booms 62 to 65, and the top boom 66 are telescopically fitted and inserted individually, the single telescopic cylinder 71 having one end that is pivotably supported by the base portion 61*a* of the base boom 61; the boom fixing means 90 including the B pins 62*d* to 66*d* (fixing pins) and the B-pin cylinder 5 (first hydraulic cylinder) that is configured to move the B pins 62*d* to 66*d* back and forth, the boom fixing means 90 being configured to fix two adjacent ones of the plurality of booms 61 to 66 using the B pins 62*d* to 66*d*; the cylinder-boom connecting means 80 including the C pin 8 (connecting pin) and the C-pin cylinder 7 (second hydraulic cylinder) that is configured to move the C pin 8 back and forth, the cylinder-boom connecting means 80 being configured to connect a specific boom to be telescoped out of the plurality of booms 62 to 66, and the telescopic cylinder 71 using the C pin 8; and the B/C-pin-cylinder hydraulic-pressure supply unit S (hydraulic-supply unit) configured to supply a hydraulic pressure to the B-pin cylinder 5 and the C-pin cylinder 7. The expansion/contraction mechanism is configured to telescope the plurality of booms 62 to 66 stage by stage by telescoping the telescopic cylinder 71 while the specific boom and the telescopic cylinder 71 are connected and the two adjacent booms including the specific boom are unfixed.

The B/C-pin-cylinder hydraulic-pressure supply unit S includes: the pneumatic-pressure source 36; the electromagnetic selector valves 37 to 39 (selector valve) configured to select a destination of air provided from the pneumatic-pressure source 36; the first pneumatic path 20A through which first air sent from the electromagnetic selector valves 37 to 39 circulates; the second pneumatic path 20B through which second air sent from the electromagnetic selector valves 37 to 39 circulates; the B-pin AOH booster 18 (first pneumatic-to-hydraulic conversion unit) configured to convert a pneumatic pressure provided by the first air to a hydraulic pressure and supply the hydraulic pressure to the B-pin cylinder 5; and the C-pin AOH booster 16 (second pneumatic-to-hydraulic conversion unit) configured to convert a pneumatic pressure provided by the second air to a hydraulic pressure and supply the hydraulic pressure to the C-pin cylinder 7.

The pneumatic-pressure source 36 and the electromagnetic selector valves 37 to 39 are placed on a fixing-unit side of the telescopic cylinder 71, and the B-pin AOH booster 18 and the C-pin AOH booster 16 are placed on a movable-portion side of the telescopic cylinder 71.

Further, in the expansion/contraction mechanism according to the first embodiment, the first pneumatic path 20A includes the B-pin pneumatic hose 46 (first pneumatic hose) and the B-pin hose reel 48 (first hose reel), the B-pin pneumatic hose 46 being configured to be unreeled from, and reeled on, the B-pin hose reel 48. Also, the second pneumatic path 20B includes the C-pin pneumatic hose 32 (second pneumatic hose) and the C-pin hose reel 30 (second hose reel), the C-pin pneumatic hose 32 being configured to be unreeled from, and reeled on, the C-pin hose reel 30. The B-pin hose reel 48 and the C-pin hose reel 30 are placed on the fixing-unit side of the telescopic cylinder 71.

With the expansion/contraction mechanism according to the first embodiment, it is possible to cause the B pins 62*d* to 66*a* and the C pin 8 to operate using the pneumatic-pressure supply/exhaust device 35 including the pneumatic-pressure source 36 and the electromagnetic selector valves 37 to 39 which are placed on a fixing-unit side of the telescopic cylinder 71 (on a side where a base portion of a telescopic boom or a crane turntable is provided) of the telescopic cylinder 71, without degrading responsiveness of the B-pin cylinder and the C-pin cylinder 7 at a low temperature. Also, the electromagnetic selector valves 37 to 39 are relocated from a side where the telescopic-cylinder movable portion 3 is provided, to a telescopic-cylinder fixing-unit side (a side where a base portion of a telescopic boom or a crane turntable is provided), so that it is possible to easily make an access to the electromagnetic selector valves 37 to 39, which results in increased ease of maintenance at a time of breakdown or the like.

In other words, in the expansion/contraction mechanism according to the first embodiment, supply of motive power from a telescopic-cylinder fixing-unit side (a side where a base portion of a telescopic boom or a crane turntable is provided) to the telescopic-cylinder movable portion 3 is achieved using a pneumatic pressure, and a pneumatic pressure is converted to a hydraulic pressure by the B-pin AOH booster 18 and the C-pin booster 16, so that the B-pin cylinder 5 and the C-pin cylinder 7 which are hydraulic cylinders are driven.

Since supply of motive power from a telescopic-cylinder fixing-unit side to the telescopic-cylinder movable portion 3 is achieved using a pneumatic pressure, extremely excellent responsiveness is attained in the B-pin cylinder 5 and the C-pin cylinder 7 irrespective of an atmosphere temperature. Therefore, operability of the expansion/contraction mechanism is ensured even at a low temperature.

Also, a size of a pipeline can be made significantly smaller than that in a case where supply of motive power from a telescopic-cylinder fixing-unit side to the telescopic-cylinder movable portion 3 is achieved using a hydraulic pressure, and a hose reel can be miniaturized and reduced in weight, so that device mountability onto a turntable is improved. Therefore, though a plurality of pneumatic pipelines and a plurality of hose reels should be placed, a space for placement is not increased as compared to a case where supply of motive power is achieved using a hydraulic pressure. Further, by configuring the C-pin pneumatic hose 32 and the B-pin pneumatic hose 46 so as to be reeled on the C-pin drum 31 and the B-pin drum 34 which can rotate coaxially with each other, it is possible to make a whole of the hose reel 52 compact.

Also, a telescopic-cylinder fixing-unit side (on a side where a base portion of a telescopic boom or a crane turntable is provided) is positioned in the neighborhood of a turntable which is at a lower level than the telescopic-cylinder movable portion 3, and so, surrounding obstacles on that side are few. Therefore, it is possible to easily make an access to the electromagnetic selector valves 37 to 39, which results in increased ease of maintenance at a time of breakdown.

Second Embodiment

Figure 11:
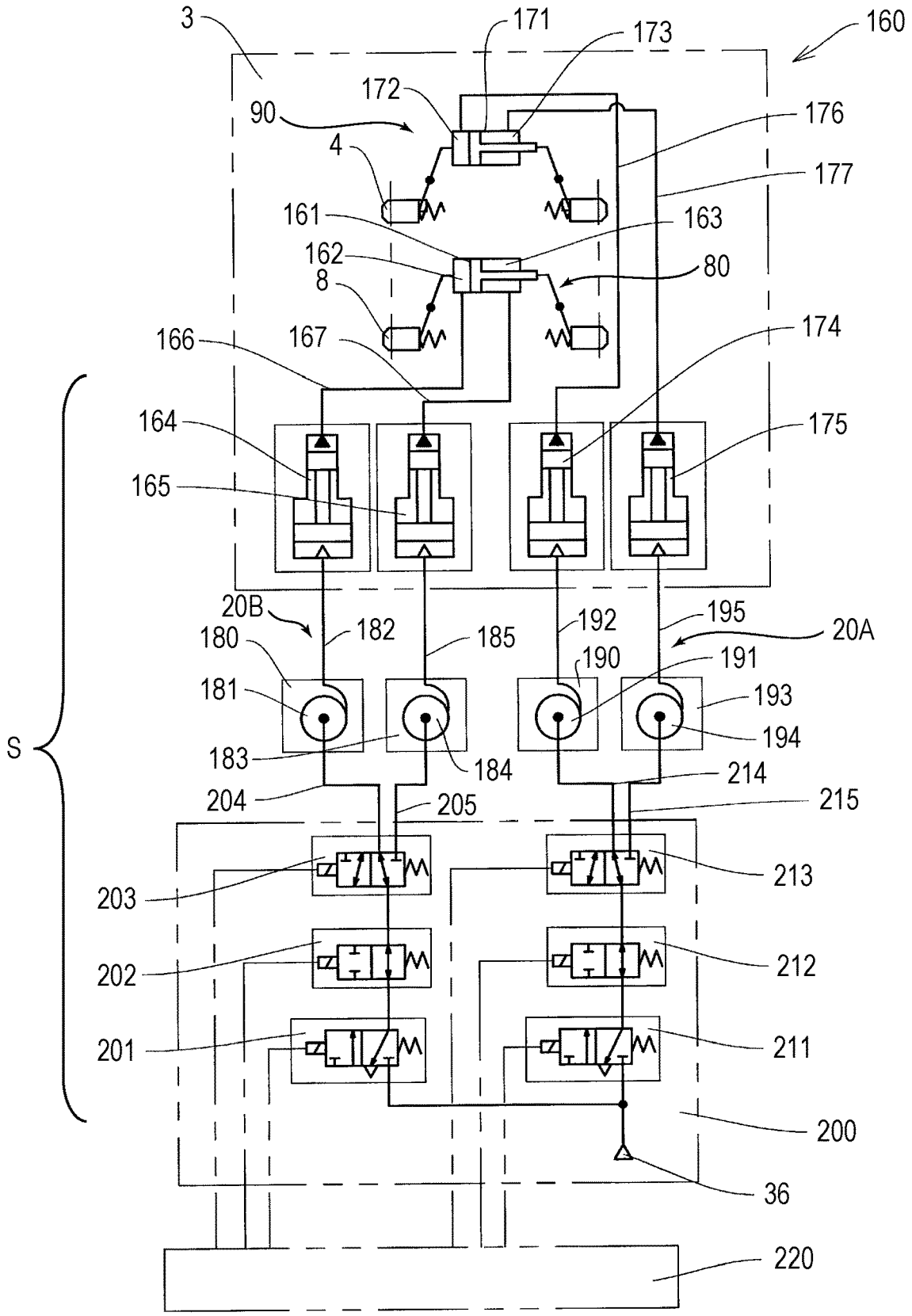
FIG. 11 is a view showing an example of a B/C-pin-cylinder hydraulic circuit of an expansion/contraction mechanism according to a second embodiment.

With reference to FIG. 11, an overview of a hydraulic circuit 160 for a B-pin cylinder 171 and a C-pin cylinder 163 (which will hereinafter be referred to as a "B/C-pin cylinder hydraulic circuit 160") of an expansion/contraction mechanism according to a second embodiment, will be given. FIG. 11 is a view showing an example of the B/C-pin cylinder hydraulic circuit 160 according to the second embodiment. In the second embodiment, each of the B-pin cylinder 171 and the C-pin cylinder 163 includes a double-acting hydraulic cylinder.

A configuration of the B/C-pin cylinder hydraulic circuit 160 is basically similar to that of the B/C-pin cylinder hydraulic circuit 10 according to the first embodiment, and so, the following description will mainly deal with differences in a configuration.

Cylinder-boom connecting means 80 includes the double-acting C-pin cylinder 161. The C-pin cylinder 161 includes an extension-side fluid chamber 162 and a contraction-side fluid chamber 163. The extension-side fluid chamber 162 is connected with a first C-pin AOH booster 164 via a hydraulic pipeline 166. The contraction-side fluid chamber 163 is connected with a second C-pin AOH booster 165 via a hydraulic pipeline 167.

Boom fixing means 90 includes the double-acting B-pin cylinder 171. The B-pin cylinder 171, like the C-pin cylinder 161, includes an extension-side fluid chamber 172 and a contraction-side fluid chamber 173. The extension-side fluid chamber 172 is connected with a first B-pin AOH booster 174 via a hydraulic pipeline 176. The contraction-side fluid chamber 173 is connected with a second B-pin AOH booster 175 via a hydraulic pipeline 177.

A first pneumatic path 20A includes a first B-pin hose reel 190, a first B-pin pneumatic hose 192, a second B-pin hose reel 193, a second B-pin pneumatic hose 195, and B-pin pneumatic pipelines 214 and 215.

The first B-pin hose reel 190 includes a first B-pin drum 191. The first B-pin pneumatic hose 192 is wound around the first B-pin drum 191 in such a manner that the hose 192 can be unreeled and reeled. The first B-pin pneumatic hose 192 is connected with the first B-pin AOH booster 174.

Likewise, the second B-pin hose reel 193 includes a second B-pin drum 194. The second B-pin pneumatic hose 195 is wound around the second B-pin drum 194 in such a manner that the hose 195 can be unreeled and reeled. The second B-pin pneumatic hose 195 is connected with the second B-pin AOH booster 175.

The B-pin pneumatic pipeline 214 connects an inlet port of the first B-pin drum 191 and one outlet port of a third B-pin electromagnetic selector valve 213. The B-pin pneumatic pipeline 215 connects an inlet port of the second B-pin drum 194 and the other outlet port of the third B-pin electromagnetic selector valve 213.

A second pneumatic path 20B includes a first C-pin hose reel 180, a first C-pin pneumatic hose 182, a second C-pin hose reel 183, a second C-pin pneumatic hose 185, and C-pin pneumatic pipelines 204 and 205.

The first C-pin hose reel 180 includes a first C-pin drum 181. The first C-pin pneumatic hose 182 is wound around the first C-pin drum 181 in such a manner that the hose 182 can be unreeled and reeled. The first C-pin pneumatic hose 182 is connected with the first C-pin AOH booster 164.

Likewise, the second C-pin hose reel 183 includes a second C-pin drum 184. The second C-pin pneumatic hose 185 is wound around the second C-pin drum 184 in such a manner that the hose 185 can be unreeled and reeled. The second C-pin pneumatic hose 185 is connected with the second. C-pin AOH booster 165. The C-pin pneumatic pipeline 204 connects an inlet port of the first C-pin drum 181 and one outlet port of a third C-pin electromagnetic selector valve 203. The C-pin pneumatic pipeline 205 connects an inlet port of the second C-pin drum 184 and the other outlet port of the third C-pin electromagnetic selector valve 203.

A pneumatic-pressure supply/exhaust device 200 includes a pneumatic-pressure source 36, a first C-pin electromagnetic selector valve 201, a second C-pin electromagnetic selector valve 202, the third C-pin electromagnetic selector valve 203, a first B-pin electromagnetic selector valve 211, a second B-pin electromagnetic selector valve 212, and a third B-pin electromagnetic selector valve 213.

The third C-pin electromagnetic selector valve 203 is connected with the first C-pin hose reel 180 via the C-pin pneumatic pipeline 204, and is connected with the second C-pin hose reel 183 via the C-pin pneumatic pipeline 205.

Also, the third B-pin electromagnetic selector valve 213 is connected with the first B-pin hose reel 190 via the B-pin pneumatic pipeline 214, and is connected with the second B-pin hose reel 193 via the B-pin pneumatic pipeline 215.

All of the electromagnetic selector valves (the first C-pin electromagnetic selector valve 201, the second C-pin electromagnetic selector valve 202, the third C-pin electromagnetic selector valve 203, the first B-pin electromagnetic selector valve 211, the second B-pin electromagnetic selector valve 212, and the third B-pin electromagnetic selector valve 213) included in the pneumatic-pressure supply/exhaust device 200 are connected with one another by a controller 220 and a signal line.

Figure 12:
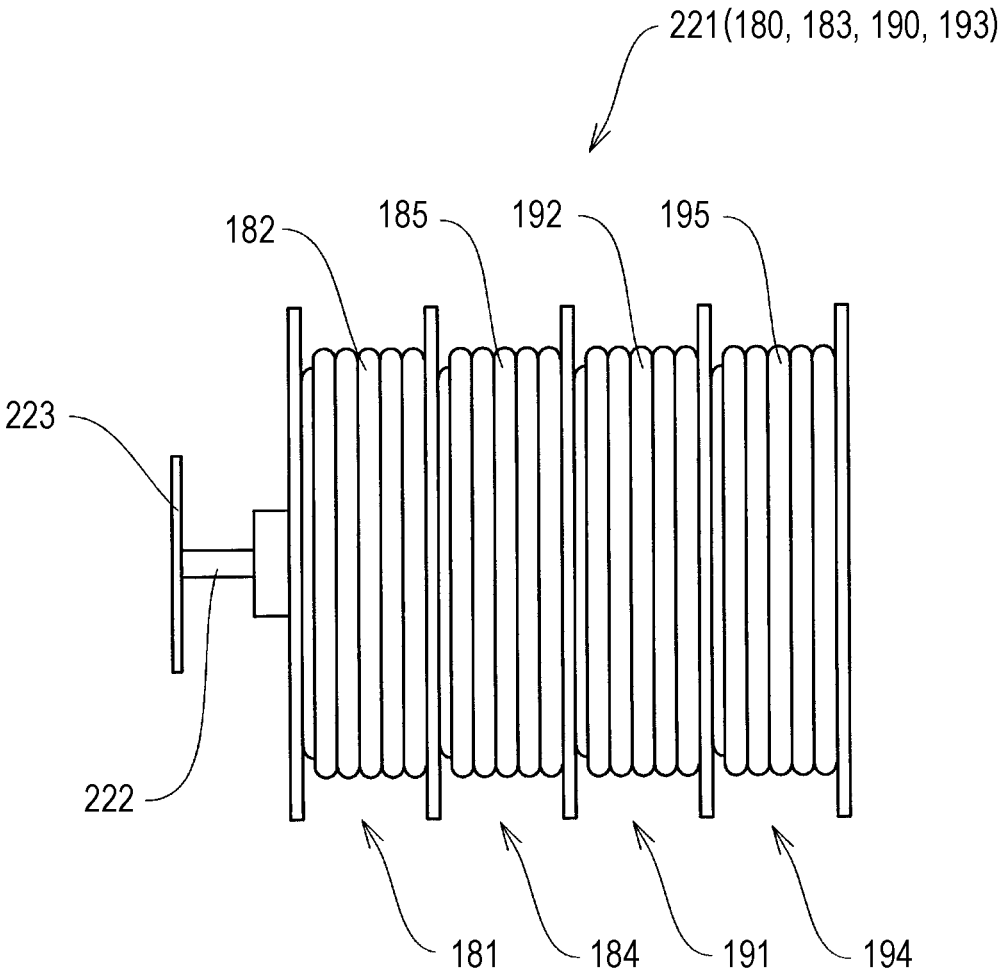
FIG. 12 is a view snowing an example of B-pin hose reels and C-pin hose reels according to the second embodiment.
Figure 13:
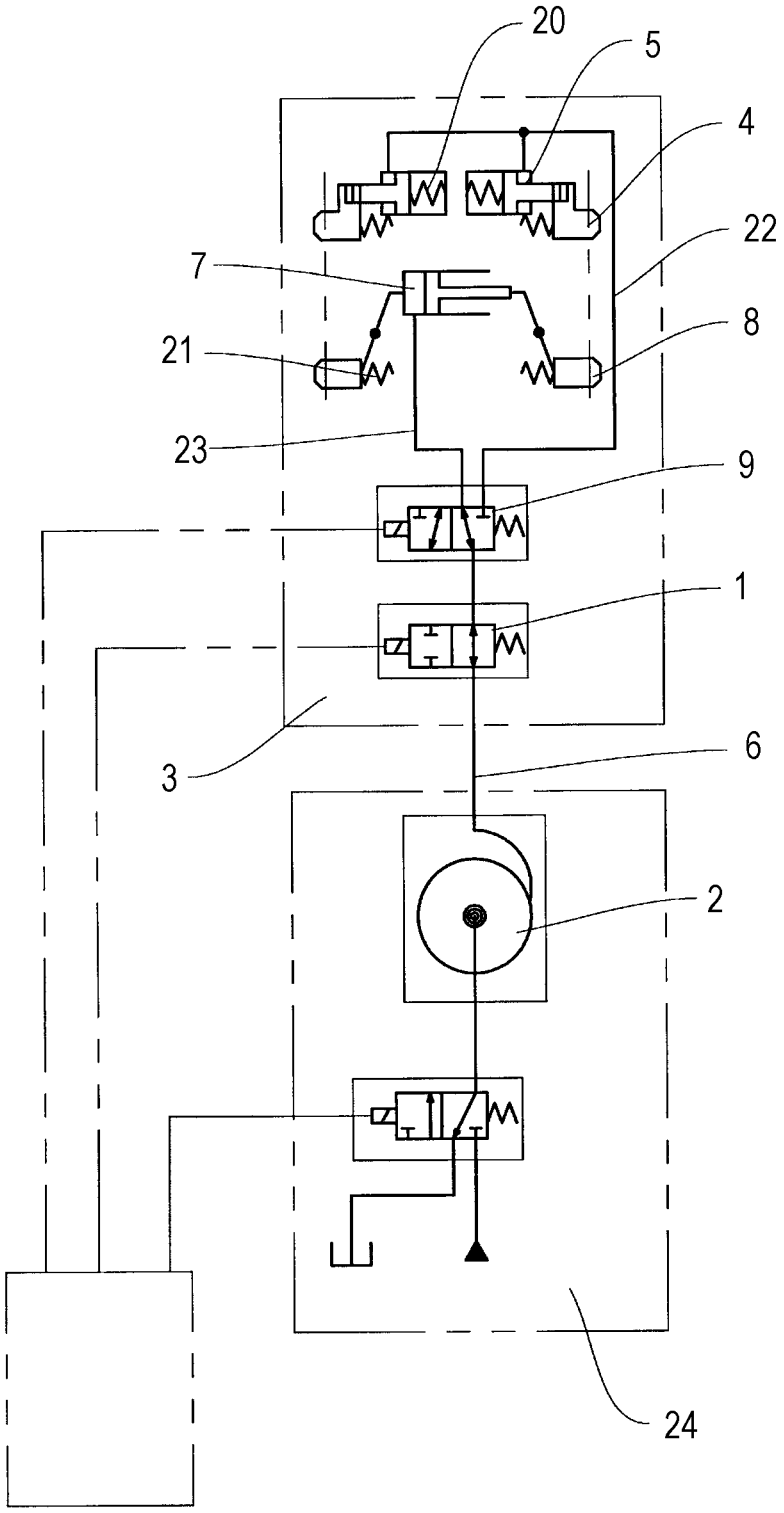
FIG. 13 is a view showing a conventional B/C-pin-cylinder hydraulic circuit.

With reference to FIG. 12, a configuration including the B-pin hose reels 190 and 193 and the C-pin hose reels 180 and 183 according to the second embodiment will be described. FIG. 12 is a view showing an example of the B-pin hose reels 190 and 193 and the C-pin hose reels 180 and 183. In FIG. 12, the B-pin hose reels 190 and 193 and the C-pin hose reels 180 and 183 are formed of the same reel member 221 (which will hereinafter be referred to as a "hose reel 221").

Around a supporting shaft 222 of the hose reel 221, the first C-pin drum 181, the second C-pin drum 184, the first B-pin drum 191, and the second B-pin drum 194 are placed coaxially with one another so as to be rotatable. The four drums 181, 184, 191, and 194 may be formed integrally with one another, or alternatively may be configured so as to rotate independently of one another.

The first C-pin pneumatic hose 182, the second C-pin pneumatic hose 185, the first B-pin pneumatic hose 192, and the second B-pin pneumatic hose 195 are wound around the first C-pin drum 181, the second C-pin drum 184, the first B-pin drum 191, and the second B-pin drum 194, respectively, in such a manner that each of the hoses can be unreeled and reeled.

The hose reel 221 includes a plate-shaped mounting unit 223 provided with a bolt hole by which the hose reel 221 is mounted onto a turntable. One end of the supporting shaft 222 is fixed to the mounting unit 223.

Because of the above-described configuration, the effects similar to those in the first embodiment can be attained even in a case where the B-pin cylinder 5 and the C-pin cylinder 7 are double-acting hydraulic cylinders. Specifically, it is possible to cause the B pin 4 and the C pin 8 to operate using the pneumatic-pressure supply/exhaust device 200 including the pneumatic-pressure source 36 and the electromagnetic selector valves 201 to 203 and 211 to 213 which are provided on a fixing-unit side of the telescopic cylinder 71, without degrading responsiveness of the B-pin cylinder 5 and the C-pin cylinder 7 at a low temperature. Also, since the electromagnetic selector valves 201 to 203 and 211 to 213 are relocated from a side where the telescopic-cylinder movable portion 3 is provided, to a telescopic-cylinder fixing-unit side, it is possible to easily make an access to the electromagnetic selector valves 201 to 203 and 211 to 213, which results in increased ease of maintenance at a time of breakdown or the like.

All the contents of disclosure in the specification, the drawings, and the abstract which are included in Japanese Patent Application No. 2016-041260 filed on Mar. 3, 2016 are applied to the present application.

REFERENCE SIGNS LIST

3 telescopic-cylinder movable portion
4 B pin
5 B-pin cylinder
7 C-pin cylinder
8 C pin
10 B/C-pin-cylinder hydraulic circuit
16 C-pin AOH booster (second pneumatic-to-hydraulic conversion unit)
18 B-pin AOH booster (first pneumatic-to-hydraulic conversion unit)
20A first pneumatic path
20B second pneumatic path
35 pneumatic-pressure supply/exhaust device

36 pneumatic-pressure source
60 telescopic boom
61 base boom
62-65 intermediate boom
66 top boom
71 telescopic cylinder
80 cylinder-boom connecting means
86 fixing hole
90 boom fixing means
91 B-pin driving means
100 expansion/contraction operation means
141 hydraulic-pressure supply means
153 telescopic-cylinder hydraulic-pressure supply unit
S B/C-pin-cylinder hydraulic-pressure supply unit

The invention claimed is:

1. An expansion/contraction mechanism comprising:

a telescopic cylinder internally mounted onto a telescopic boom into which a plurality of booms including a base boom, an intermediate boom, and a top boom are telescopically fitted and inserted individually, the telescopic cylinder having one end that is pivotably supported by a base portion of the base boom;

boom fixing means including a fixing pin and a first hydraulic cylinder that is configured to move the fixing pin back and forth, the boom fixing means being configured to fix two adjacent ones of the plurality of booms using the fixing pin;

cylinder-boom connecting means including a connecting pin and a second hydraulic cylinder that is configured to move the connecting pin back and forth, the cylinder-boom connecting means being configured to connect a specific boom to be telescoped out of the plurality of booms except the base boom, and the telescopic cylinder, using the connecting pin; and a hydraulic-pressure supply unit configured to supply a hydraulic pressure to the first hydraulic cylinder and the second hydraulic cylinder, wherein the expansion/contraction mechanism is configured to telescope the plurality of booms except the base boom by telescoping the telescopic cylinder while the specific boom and the telescopic cylinder are connected and the two adjacent booms including the specific boom are unfixed, the hydraulic-pressure supply unit includes:

a pneumatic-pressure source;

a selector valve configured to select a destination of air provided from the pneumatic-pressure source;

a first pneumatic path through which first air sent from the selector valve circulates;

a second pneumatic path through which second air sent from the selector valve circulates;

a first pneumatic-to-hydraulic conversion unit configured to convert a pneumatic pressure provided by the first air to a hydraulic pressure and supply the hydraulic pressure to the first hydraulic cylinder; and a second pneumatic-to-hydraulic conversion unit configured to convert a pneumatic pressure provided by the second air to a hydraulic pressure and supply the hydraulic pressure to the second hydraulic cylinder;

the pneumatic-pressure source and the selector valve are placed on a fixing-unit side of the telescopic cylinder, and the first pneumatic-to-hydraulic conversion unit and the second pneumatic-to-hydraulic conversion unit are placed on a movable-portion side of the telescopic cylinder.

2. The expansion/contraction mechanism according to claim 1, wherein the selector valve includes a first selector valve configured to select either supply of a pneumatic pressure to the hydraulic-pressure supply unit or evacuation of the hydraulic-pressure supply unit, a second selector valve configured to select either supply of a pneumatic pressure to the hydraulic-pressure supply unit or holding of a pneumatic pressure in the hydraulic-pressure supply unit, and a third selector valve configured to select either the first pneumatic path or the second pneumatic path as a destination of supply of a pneumatic pressure, the first, second and third selector valves being sequentially placed in the stated order, starting from a side where the pneumatic-pressure source is provided.

3. The expansion/contraction mechanism according to claim 1, wherein the first pneumatic path includes a first pneumatic hose and a first hose reel, the first pneumatic hose being configured to be unreeled from, and reeled on, the first hose reel, the second pneumatic path includes a second pneumatic hose and a second hose reel, the second pneumatic hose being configured to be unreeled from, and reeled on, the second hose reel, and the first hose reel and the second hose reel are placed on the fixing-unit side of the telescopic cylinder.

4. The expansion/contraction mechanism according to claim 3, wherein the first hose reel and the second hose reel are formed of the same hose reel member.

5. The expansion/contraction mechanism according to claim 1, wherein each of the first hydraulic cylinder and the second hydraulic cylinder is a single-acting hydraulic cylinder.

* * * * *